US008602566B2

(12) United States Patent
Baier et al.

(10) Patent No.: US 8,602,566 B2
(45) Date of Patent: Dec. 10, 2013

(54) METHOD AND ELECTRONIC OPERATING DEVICE FOR OPERATING A GAS DISCHARGE LAMP AND PROJECTOR

(75) Inventors: Markus Baier, München (DE); Martin Brueckel, Shenzhen (CN); Bärbel Dierks, Wandlitz OT Schönwalde (DE); Peter Flesch, Berlin (DE); Josef Kroell, Potsdam (DE); Oskar Schallmoser, Ottobrunn (DE); Kai Wolter, Berlin (DE)

(73) Assignee: OSRAM AG, Munich (DE)

( * ) Notice: Subject to any disclaimer, the term of this patent is extended or adjusted under 35 U.S.C. 154(b) by 266 days.

(21) Appl. No.: 13/146,412

(22) PCT Filed: Jan. 13, 2010

(86) PCT No.: PCT/EP2010/050311

§ 371 (c)(1), (2), (4) Date: Sep. 13, 2011

(87) PCT Pub. No.: WO2010/086222

PCT Pub. Date: Aug. 5, 2010

(65) Prior Publication Data

US 2011/0317133 A1 Dec. 29, 2011

(30) Foreign Application Priority Data

Jan. 27, 2009 (DE) ..... 10 2009 006 338

(51) Int. Cl.
*H05B 41/36* (2006.01)

(52) U.S. Cl.
USPC ..... 353/85; 315/224

(58) Field of Classification Search
USPC ..... 353/85; 315/224
See application file for complete search history.

(56) References Cited

U.S. PATENT DOCUMENTS

| | | | | |
|---|---|---|---|---|
| 5,633,755 | A | 5/1997 | Manabe et al. | |
| 6,323,982 | B1 | 11/2001 | Hornbeck | |
| 8,174,208 | B2 * | 5/2012 | Van Den Berg | 315/291 |
| 8,362,708 | B2 * | 1/2013 | Breuer et al. | 315/291 |
| 8,487,540 | B2 * | 7/2013 | Dijkstra et al. | 315/209 R |
| 2009/0256491 | A1 | 10/2009 | Brückel et al. | |
| 2010/0171434 | A1 | 7/2010 | Breuer et al. | |

FOREIGN PATENT DOCUMENTS

| | | | |
|---|---|---|---|
| EP | 1309228 | A2 | 5/2003 |
| EP | 2152048 | A2 | 2/2010 |
| WO | 2007045599 | A1 | 4/2007 |
| WO | 2008053428 | A1 | 5/2008 |
| WO | 2008151669 | A1 | 12/2008 |
| WO | 2009007914 | A1 | 1/2009 |

* cited by examiner

*Primary Examiner* — Tony Ko

(57) ABSTRACT

A method for operating a gas discharge lamp featuring a gas discharge lamp burner and a first and a second electrode, wherein the electrodes have a nominal electrode separation in the gas discharge lamp burner before their first activation and said nominal separation is correlated to the lamp voltage. The method may include checking whether the off-time, corresponding to the time duration between two DC voltage phases, has expired; and if the off-time has expired, omitting commutations or applying pseudo-commutations for a predefined time duration which depends on the lamp voltage in such a way that a time duration of the omission of at least one of commutations and application of pseudo-commutations is predefined for each lamp voltage.

20 Claims, 18 Drawing Sheets

| | $S_Y$ | $S_G$ | $S_M$ | $S_R$ | $S_C$ | $S_B$ | $S_Y$ | $S_G$ | $S_M$ | $S_R$ | $S_C$ | $S_B$ |
|---|---|---|---|---|---|---|---|---|---|---|---|---|
| segment size (*) | 60 | 60 | 40 | 70 | 62 | 68 | 60 | 60 | 40 | 70 | 62 | 68 |
| communication (after that segment/in spoke) | | | X | | X | | X | | | X | | X |
| segment light level (%) | 80 | 80 | 120 | 120 | 80 | 120 | 80 | 80 | 120 | 120 | 80 | 120 |
| negative pulse light level (%) | 40 | 40 | 60 | 60 | 40 | 60 | 40 | 40 | 60 | 60 | 40 | 60 |

METHOD AND ELECTRONIC OPERATING DEVICE FOR OPERATING A GAS DISCHARGE LAMP AND PROJECTOR

RELATED APPLICATIONS

The present application is a national stage entry according to 35 U.S.C. §371 of PCT application No.: PCT/EP2010/050311 filed on Jan. 13, 2010, which claims priority from German application No.: 10 2009 006 338.2 filed on Jan. 27, 2009.

TECHNICAL FIELD

Various embodiments relate to a method and an electronic operating device for operating a gas discharge lamp comprising a gas discharge lamp burner and a first and a second electrode, wherein the electrodes have a nominal electrode separation in the gas discharge lamp burner before their first activation and said nominal separation is correlated to the lamp voltage.

BACKGROUND

In recent times, use of gas discharge lamps instead of incandescent bulbs is growing as a result of their high efficiency. In terms of operation, high pressure discharge lamps are more difficult to handle than low pressure discharge lamps in this case, and the electronic operating devices for these lamps are therefore more expensive.

High pressure discharge lamps are usually operated by means of a low-frequency square-wave current, also known as intermittent direct current operation. In this case, an essentially square-wave current having a frequency of usually 50 Hz to several kHz is applied to the lamp. The lamp commutates with each oscillation between positive and negative voltage, because the current direction also changes and the current is therefore briefly at zero. This operation ensures that the electrodes of the lamp are uniformly loaded in spite of quasi-direct current operation.

Gas discharge lamps are successfully used for display systems, for example, because they can generate a high luminance which can be subsequently processed by an inexpensive lens system. Display systems and their lighting apparatus are described in the publications U.S. Pat. Nos. 5,633,755 and 6,323,982, for example. Display systems such as DLP projectors (DLP: digital light processing) include a lighting apparatus having a light source whose light is directed onto a DMD chip (DMD: digital mirror device). The DMD chip microscopically includes small tilting mirrors, which either direct the light onto the projection surface if the associated pixel is to be turned on, or direct the light away from the projection surface, e.g. onto an absorber, if the associated pixel is to be switched off. Each mirror therefore acts as a light valve which controls the light level of a pixel. These light valves are generally known as DMD light valves. For the purpose of generating colors in the case of a lighting apparatus which emits white light, a DLP projector includes a filter wheel, for example, which is arranged between lighting apparatus and DMD chip and contains filters of various colors, e.g. red, green and blue. By means of the filter wheel, light of the currently desired color is sequentially transmitted from the white light of the lighting apparatus.

The color temperature of such display systems is normally dependent on the spectrum locus of the light of the lighting apparatus. This usually changes according to the operating parameters of the light sources of the lighting apparatus, e.g. voltage, current intensity and temperature. Furthermore, depending on the light sources used in the lighting apparatus, the ratio between current intensity and light level is not necessarily linear. Consequently, a change of the current intensity also results in a change of the spectrum locus of the light of the light source, and hence in a change of the color temperature of the display system.

Furthermore, the color depth of the display system is limited by the minimal ON-time of a pixel. In order to increase the color depth, it is possible to implement e.g. dithering, wherein individual pixels are switched using a lower frequency than the regular frequency of 1/60 Hz. However, this usually results in noise which is visible to a human observer.

The contrast ratio of the display system is defined by the ratio of the maximal light level resulting from fully opened light valves to minimal light level resulting from fully closed light valves. In order to increase the contrast ratio of a display system, the minimal light level resulting from fully closed light valves can be further reduced by means of a mechanical screen, for example. However, a mechanical screen requires space in the lighting apparatus or the display system, increases the weight of the lighting apparatus or the display system, and also represents an additional potential source of interference. High pressure discharge lamps such as those used in such display systems can also be operated in a dimmed mode, though the dimmed operating mode raises problems with regard to the electrode temperature and the arc root in the high pressure discharge lamp.

The arc root is generally problematic when alternating current is used for operation of a gas discharge lamp. When alternating current is used for operation, a cathode becomes an anode and an anode conversely becomes a cathode during commutation of the operating voltage. The cathode-anode transition is not problematic in principle, since the temperature of the electrode does not have any effect on its anodic operation. In the case of the anode-cathode transition, the ability of the electrode to supply a sufficiently high current is dependent on its temperature. If this is too low, the electric arc changes during the commutation, usually following a zero crossing, from a concentrated arc root operating mode to a scattered arc root operating mode. This change is accompanied by an interruption in the light output, which is often visible and can be perceived as flickering.

Ideally therefore, the lamp is operated in concentrated arc root operating mode, since the arc root in this case is very small and therefore very hot. As a consequence of this, less voltage is required here due to the higher temperature at the small root point, in order to be able to supply sufficient current. An electrode tip which has a uniform shape and whose surface is not fissured supports the concentrated arc root operating mode and hence safer and more reliable operation of the gas discharge lamp.

In the following, commutation is considered to be the process in which the polarity of the voltage of the gas discharge lamp alternates, and in which a significant change in current or voltage therefore occurs. In the case of an essentially symmetrical operating mode of the lamp, the voltage zero or current zero occurs in the middle of the commutation time. It should be noted in this context that the voltage commutation usually always occurs more quickly than the current commutation.

The inner end of the lamp electrode, said inner end projecting into the discharge space of the gas discharge lamp burner, is referred to below as an electrode end. A needle or peak-shaped raised part which is positioned on the electrode end, and whose end is used as a root point for the electric arc, is referred to as an electrode tip.

The variation or distortion of the electrodes over the entire service life represents a significant problem of high pressure discharge lamps. In this case, the shape of the electrode changes from the ideal shape to an increasingly fissured surface, particularly at the inner end of the electrode. Moreover, there is a risk of producing electrode tips that are not arranged in the center of the relevant electrode. The discharge arc always forms from electrode tip to electrode tip. If a plurality of electrode tips of approximately equal validity are present on an electrode, this can result in arc jumping and hence to flickering of the lamp. Electrode tips which grow non-centrically will degrade the optical image, since the lens system of a projector or a light (in which such a discharge lamp is installed) is configured relative to a specific position of the discharge arc, and in particular is adjusted relative to the initial state of the electrodes and the discharge arc. In certain cases, the electrode tips can grow unevenly, such that the electric arc is no longer arranged centrally in the burner vessel, but is shifted axially. This likewise degrades the optical image of the overall system. By contrast, the fissuring results in an increase of the original electrode separation and therefore also affects the lamp voltage. As this increases proportionally relative to the separation, it can result in premature service life shutdown, since this usually occurs when the lamp voltage exceeds a predetermined threshold value. In summary, this results in a reduction in the lamp service life and in the quality of the light emitted from the lamp.

The prior art does not currently disclose any solutions to these problems. Merely for the sake of completeness, reference is made to WO 2007/045599 A1. While the problem giving cause to the present invention occurs at the end of the lamp service life, the cited publication addresses a problem which occurs within the first three hundred operating hours. Tip growth can occur during this period, resulting in a reduction of the electrode separation. This causes the lamp voltage to decrease, such that the current to be supplied by an electronic operating device must be increased in order to achieve a constant power. Since electronic operating devices are naturally configured for a specific maximum current, this results in problems. In order to avoid an increase of the current configuration for the continuous operation and the resulting occurrence of additional costs, the cited publication proposes that a current pulse be applied to the electrodes, such that the electrode tips which have grown are fused back. In this way, the separation of the electrodes can be increased again, the lamp voltage increased, and the required current therefore decreased. By contrast, however, the present invention addresses the problem of conserving the electrodes in an optimal state, as far as possible over the entire service life of the gas discharge lamp, wherein the electrodes have a relative separation which corresponds as far as possible to the original separation that is present in a new lamp, and wherein the surface of the electrode ends remains smooth and has tips which grow centrically, forming a defined root point for the arc. The teaching of WO 2007/045599 A1 does not therefore solve the problem cited above.

SUMMARY

Various embodiments provide a method and an electronic operating device for operating a gas discharge lamp including a gas discharge lamp burner and a first and a second electrode, wherein the electrodes have a nominal electrode separation in the gas discharge lamp burner before their first activation, and the gas discharge lamp no longer exhibits the above cited problem when the electronic operating device is operating using the method according to various embodiments. Various embodiments provide a projector which features such an electronic operating device.

Various embodiments provide a method for operating a gas discharge lamp including a gas discharge lamp burner and a first and a second electrode, wherein the electrodes have a nominal electrode separation in the gas discharge lamp burner before their first activation and said nominal separation is correlated to the lamp voltage, including:

a) checking whether the lamp voltage of the gas discharge lamp is less than a lower lamp voltage threshold or greater than an upper lamp voltage threshold of the gas discharge lamp; and b) repeatedly applying a DC voltage phase at a predefined temporal interval, such that the length of the DC voltage phase is dependent on the lamp voltage.

As a result of the length of the DC voltage phase being dependent on the lamp voltage, good control accuracy can be achieved and the shaping of the electrodes is particularly efficient. In this case, the length of the DC voltage phase is preferably between 2 ms and 500 ms, and the length between the DC voltage phases is preferably between 180 s and 900 s. The time durations can be precisely specified within this range depending on the lamp type, in order to ensure particularly efficient shaping of the electrodes.

In a further preferred embodiment, the length of the DC voltage phases is determined by the change or the rise in the lamp voltage during these DC voltage phases. In case the rise criterion is not satisfied, a maximal duration of the DC voltage phases can be predetermined, wherein said maximal duration can again depend on e.g. the lamp voltage as in the previous embodiment. As a result of this measure, the accuracy with which the electrodes can be regulated is clearly increased and the likelihood of excessive energy input is thereby reduced.

If the predefined separation of the DC voltage phases is between 180 s and 900 s, the electrodes are not excessively loaded and the service life of the gas discharge lamp is not adversely affected.

An upper lamp voltage threshold is preferably between 60 V and 110 V, and a lower lamp voltage threshold is preferably between 45 V and 85 V, in particular between 55 V and 75 V. The lamp voltage thresholds can be precisely specified within this range depending on the lamp type, in order that the method can be optimized for this lamp type.

The operation of the gas discharge lamp using an alternating current, onto whose half-waves is modulated a pulse of higher current intensity, said pulse having a length of between 50 μs and 1500 μs, facilitates the shaping of the electrodes by means of the inventive method and makes said method even more efficient.

The length of the DC voltage phase can preferably be adjusted by virtue of a half-wave of the applied alternating current consisting of a plurality of partial half-waves, wherein some or all of the commutations between two half-waves are reversed again by means of a further commutation occurring shortly thereafter.

As a result of this measure, it is possible to generate DC voltage phases whose length is a multiple of a partial half-wave. By means of statistical distribution of various lengths of the DC voltage phases, it is possible on average to generate any chosen lengths of the DC voltage phases, and the energy input into the electrodes can therefore be accurately controlled. The current can only flow in one direction during the DC voltage phases, or else the polarity is reversed once in the DC voltage phase and the current flows in both directions during the DC voltage phases. The energy input can be equally distributed in each direction as part of this activity, or else the energy input can be preferentially in one current direction, such that one lamp electrode is heated more than the other. If the current only flows in one direction during a DC voltage phase, it can flow in the other direction during the following DC voltage phase. Combinations can also be conceived in which the current flows in one direction during the first two DC voltage phases, and the current flows in the other direction during the following two DC voltage phases. Provision can also be made here for preferential energy input into one electrode, whereby e.g. the current flows in one direction during the first two DC voltage phases, the current flows in the other direction during the third DC voltage phase, and the current flows in the first direction again during the fourth and fifth DC voltage phases. If the various partial half-waves of a half-wave apply different current intensities to the gas discharge lamp, the method can be refined further, and the desired average energy input can be introduced into the electrode in a shorter time.

Various embodiments provide an electronic operating device which performs a method in accordance with one or more of the features cited above. By virtue of this measure, the operating device is able optimally to maintain the gas discharge lamp.

Various embodiments provide a projector device, wherein the projector is designed to project an image during the execution of the inventive method in such a way that the execution of the method is not apparent from the image. By virtue of this measure, the method can be executed at any time without affecting the live operation, and therefore the lamp can be maintained at any time.

Further advantageous developments and embodiments of the inventive method and of the inventive electronic operating device for operating a gas discharge lamp are derived from further dependent claims and from the following description.

BRIEF DESCRIPTION OF THE DRAWING(S)

Further advantages, features and details of the invention are revealed with reference to the following description of exemplary embodiments and with reference to the drawings, in which identical or functionally identical elements are denoted by means of identical reference signs, and in which.

Figure 6A:
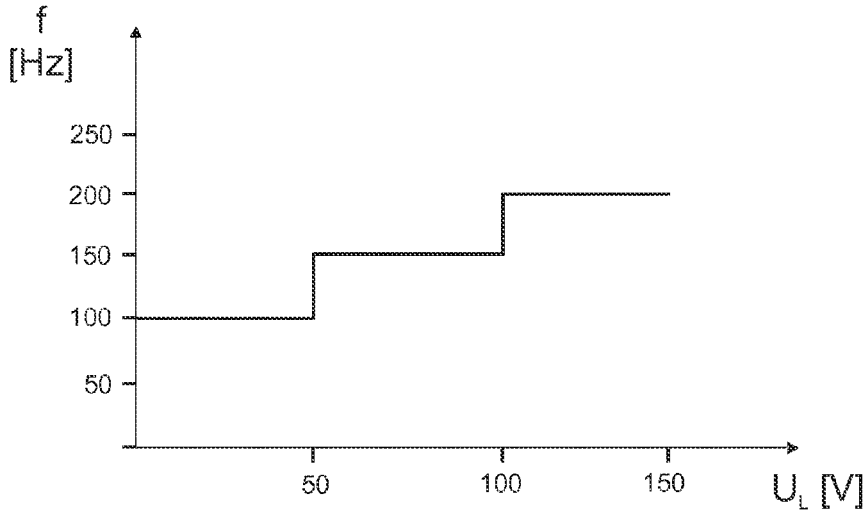
Figure 6B:
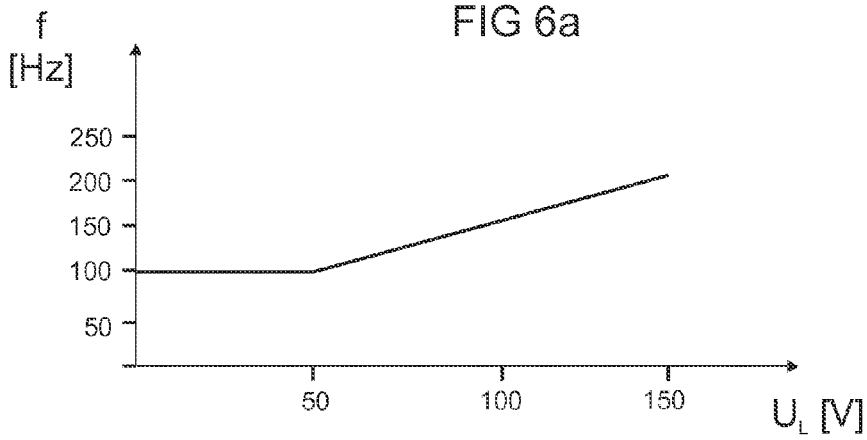
Figure 6C:
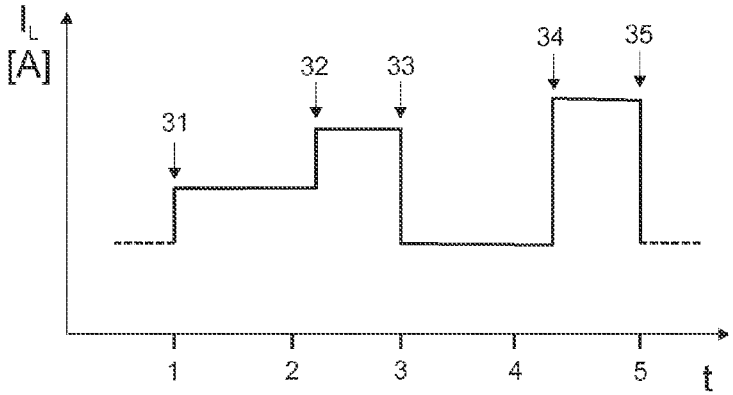
Figure 7:
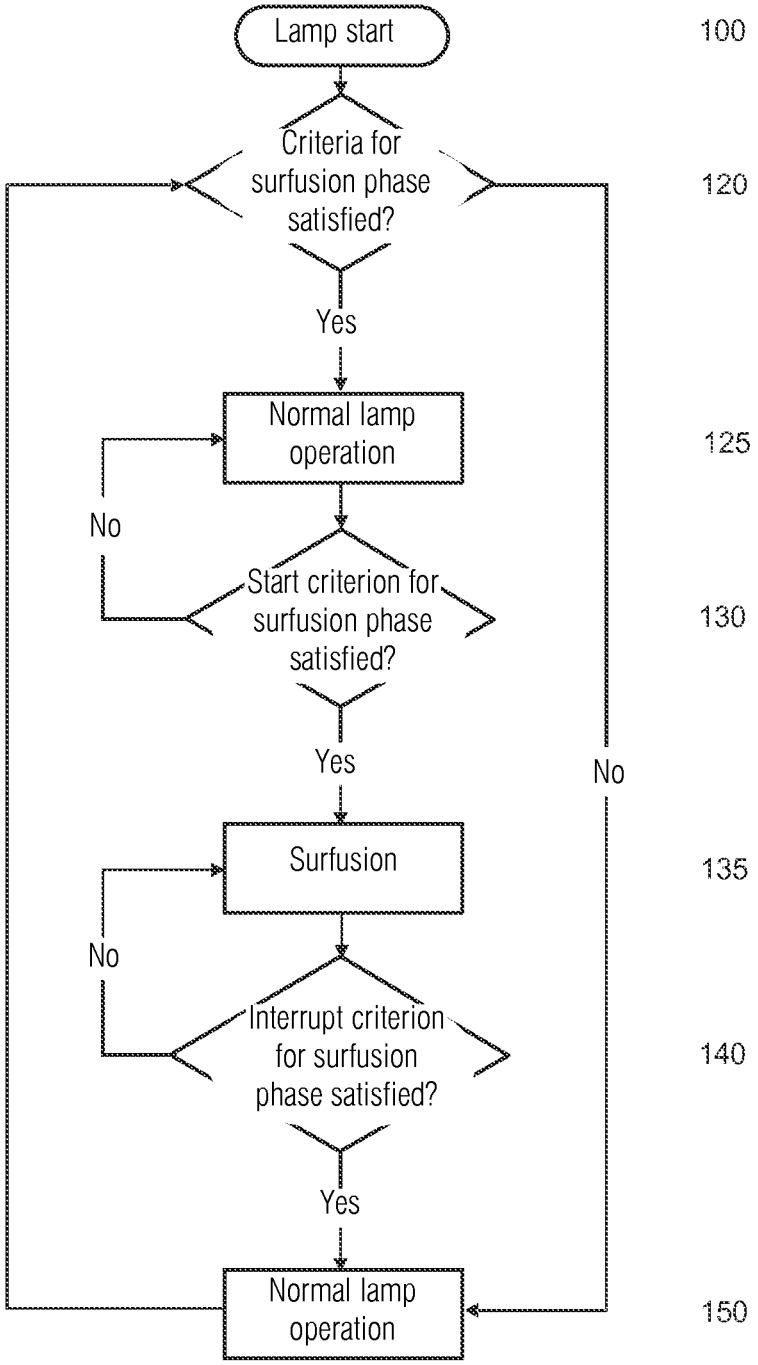
Figure 8:
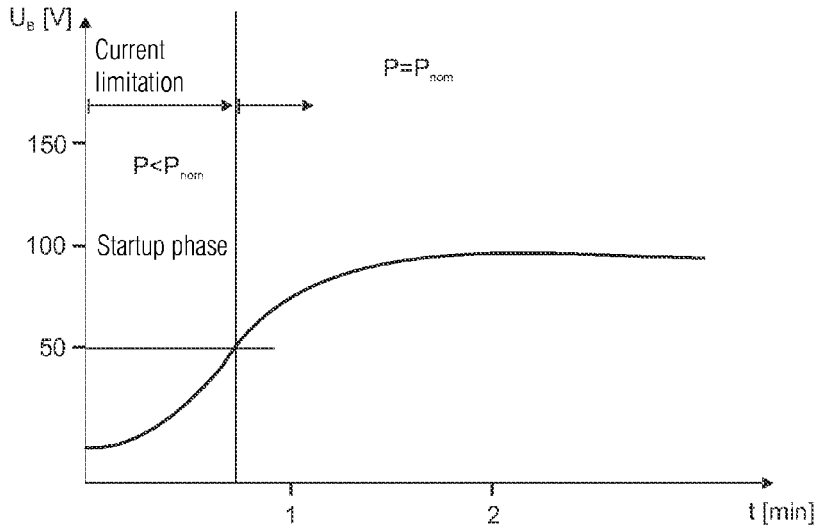
Figure 9:
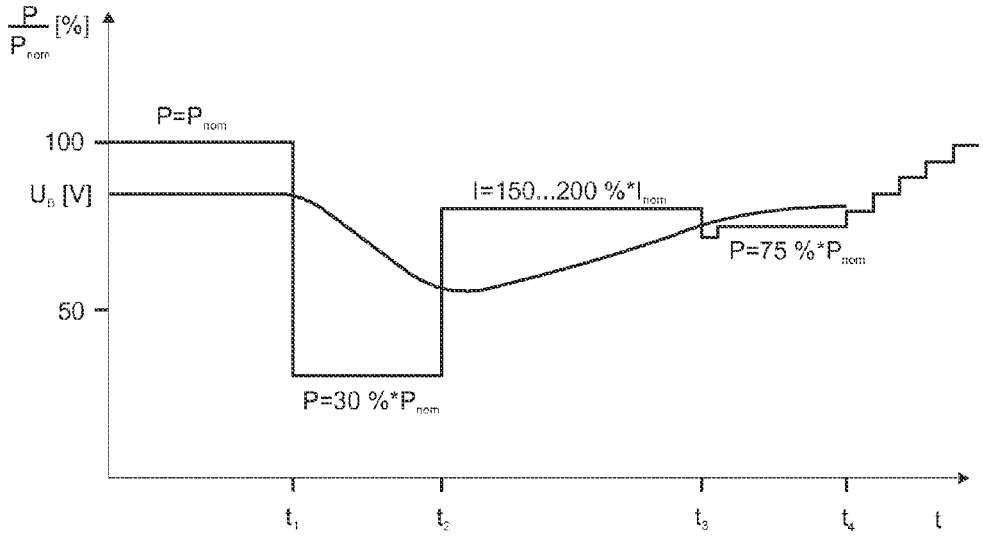
Figure 11:
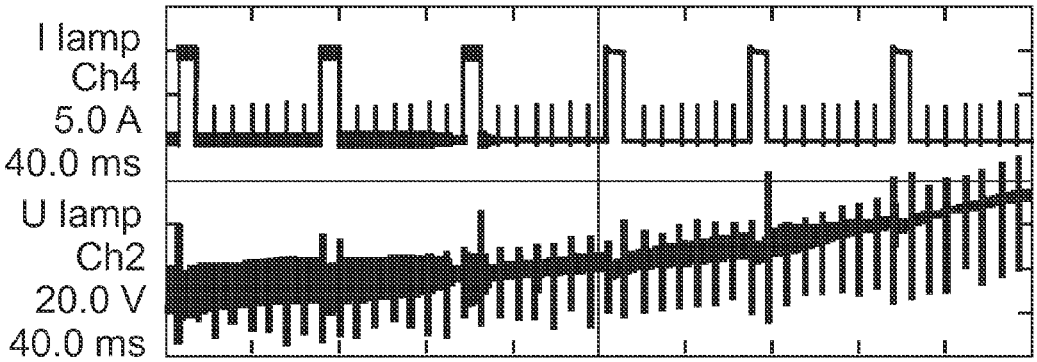
Figure 12:
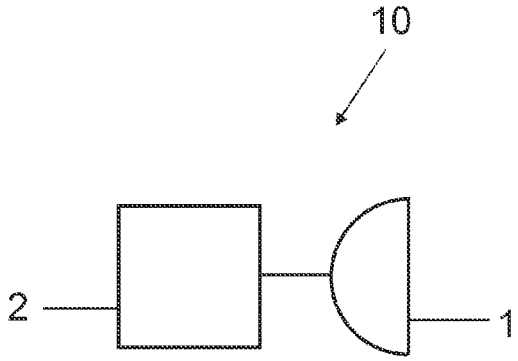
Figure 13:
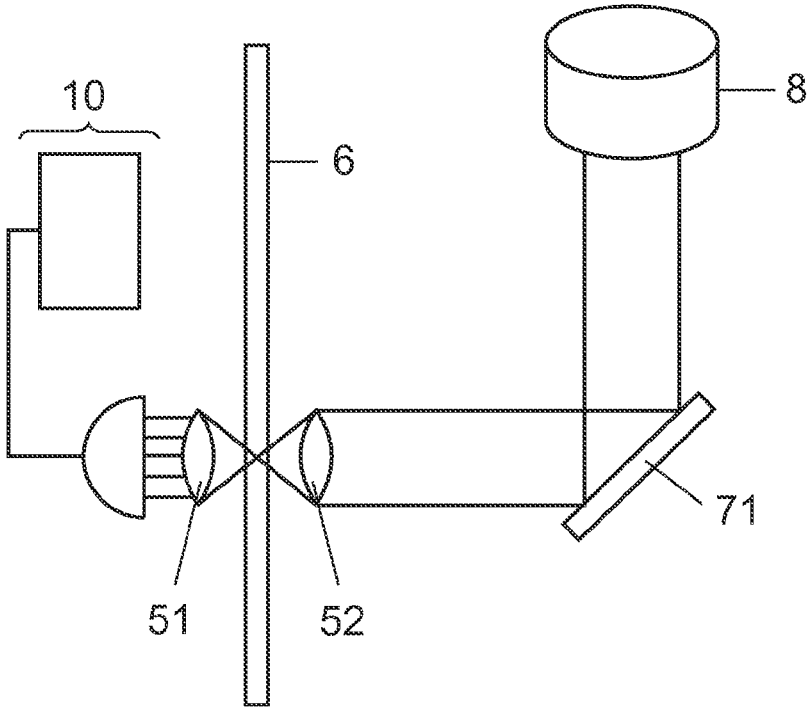
Figure 14:
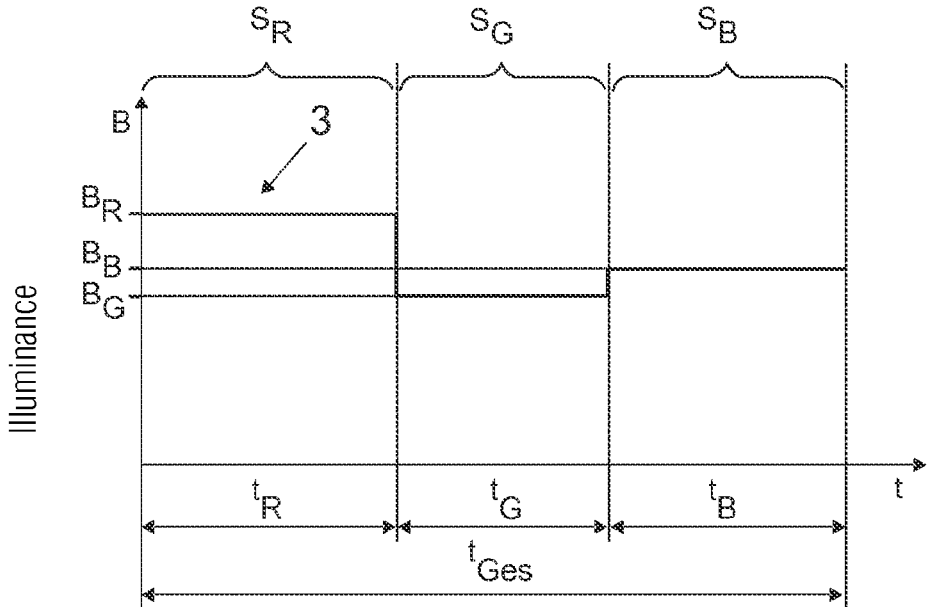
Figure 15A:
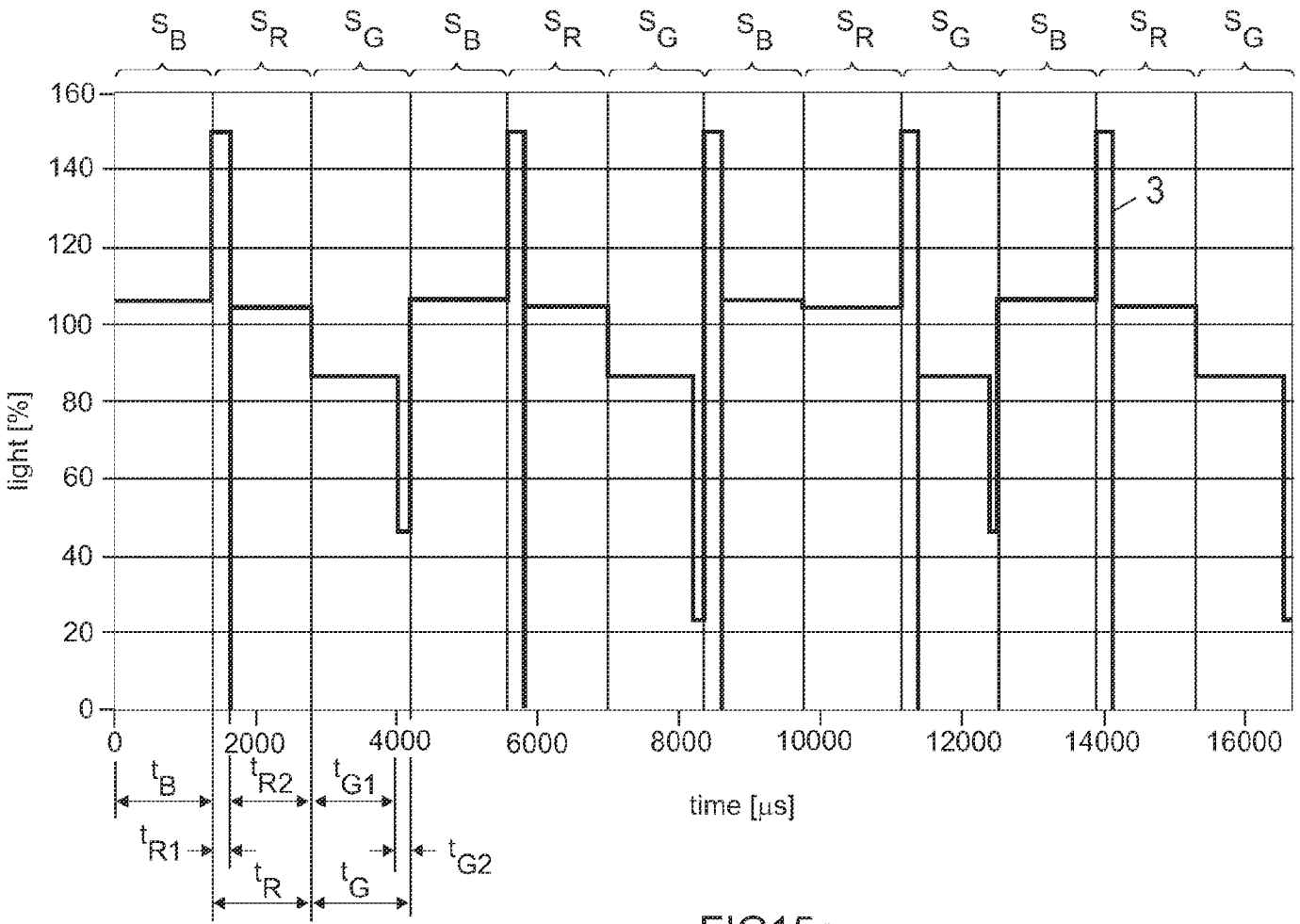
Figure 15B:
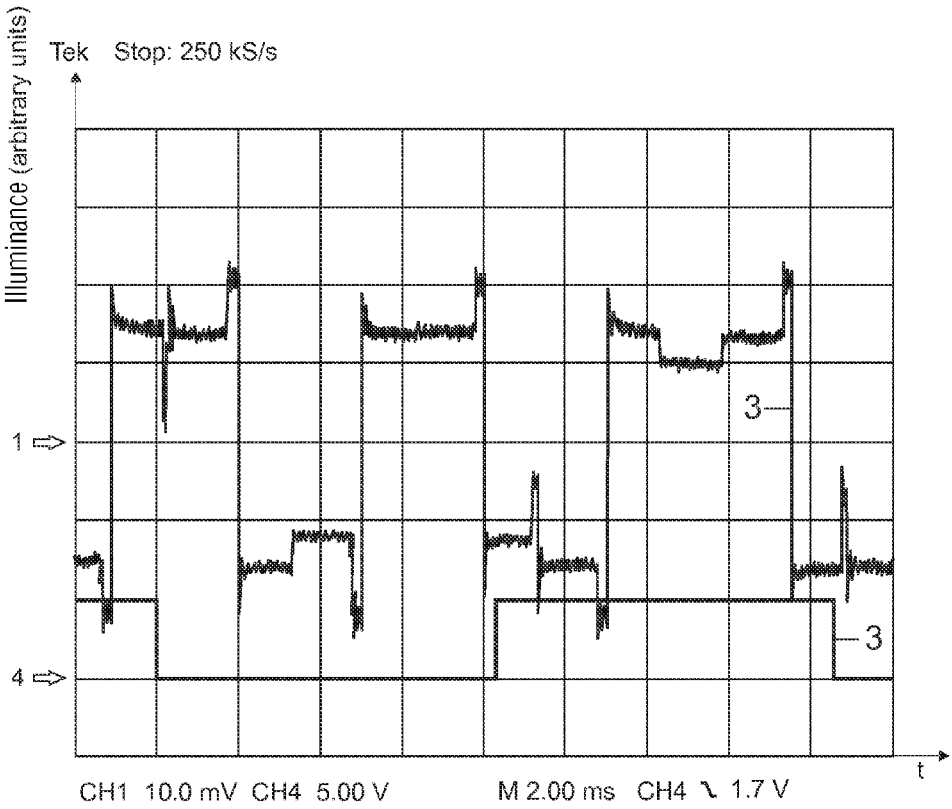
Figures 15C, 15D:
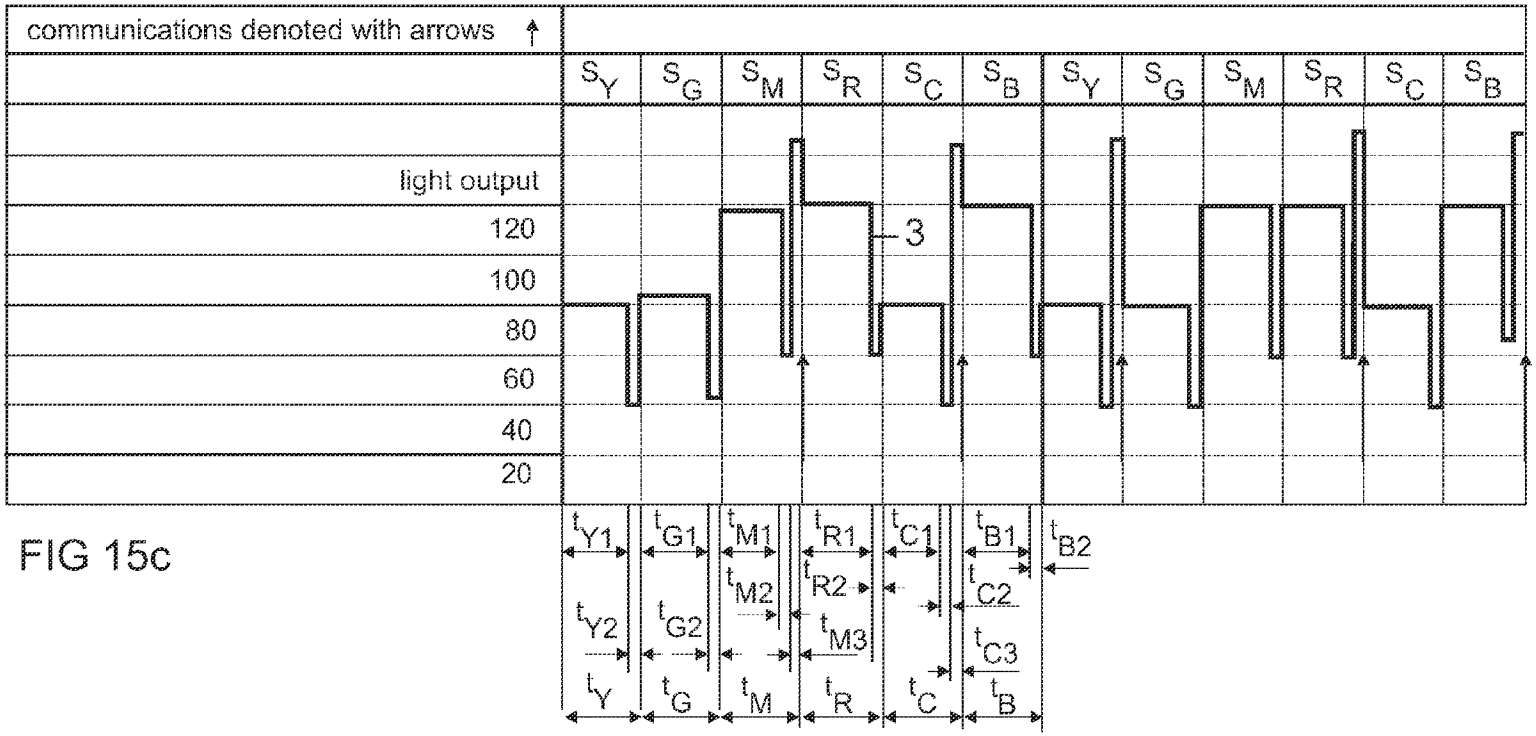
Figure 15E:
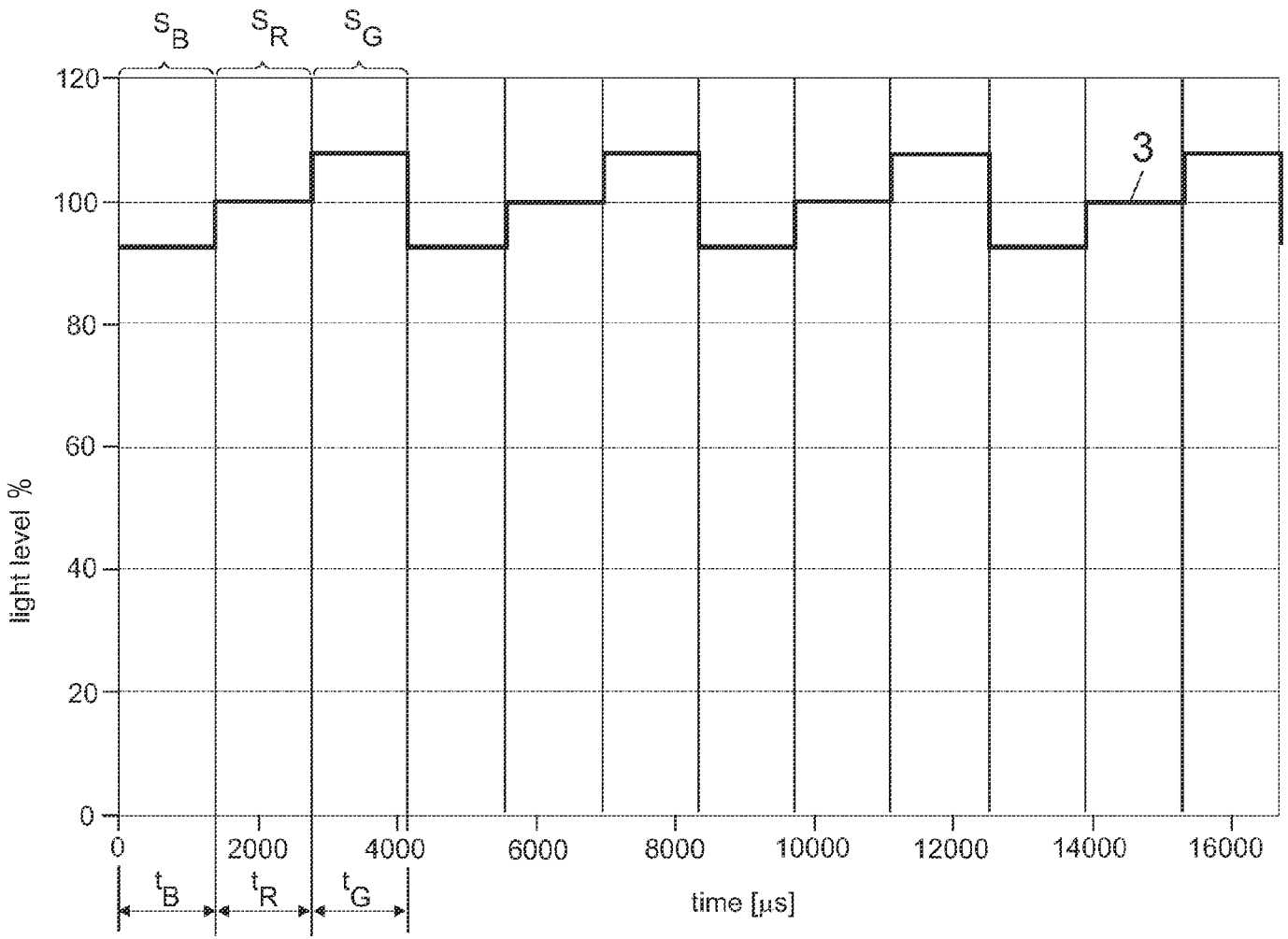
Figure 15F:
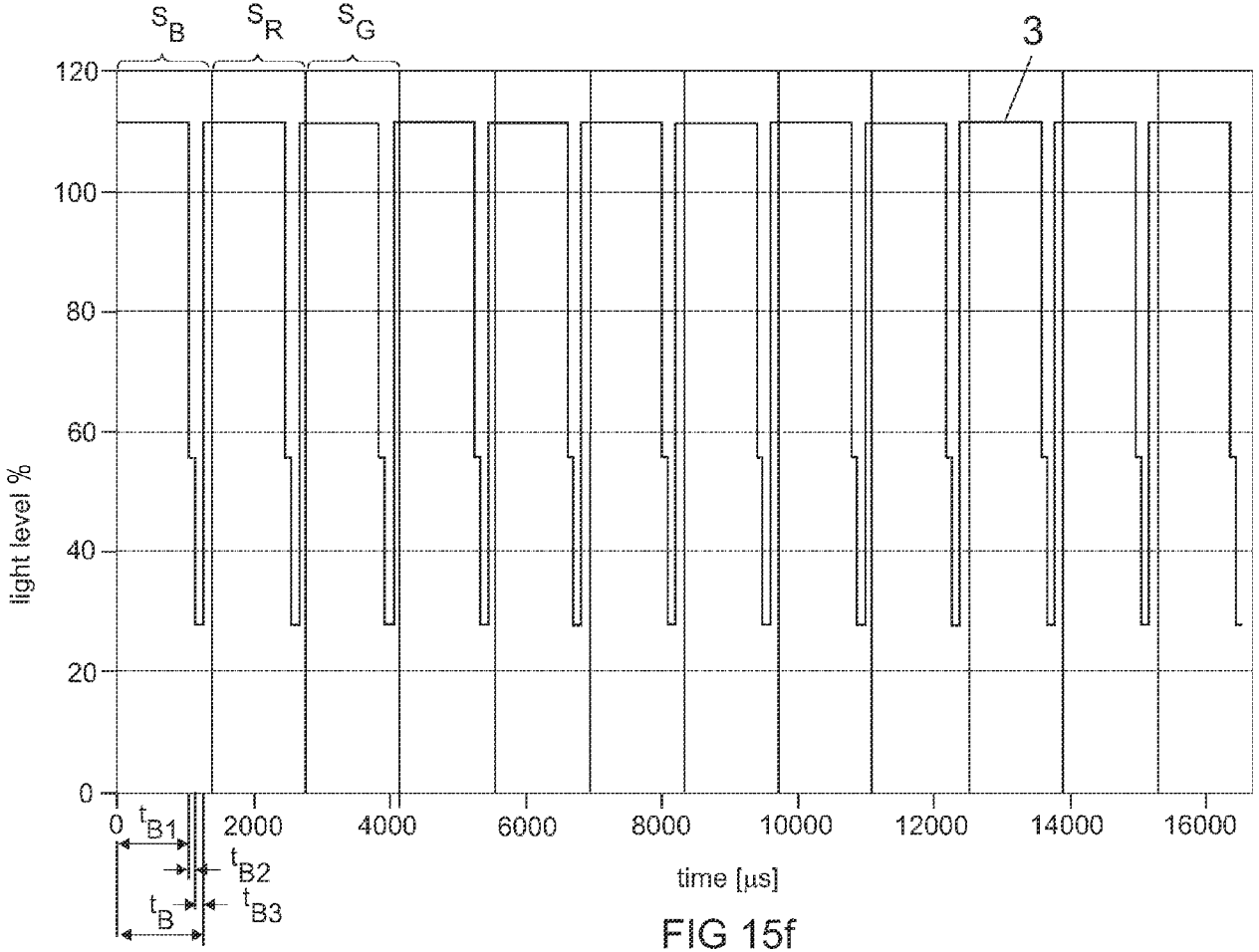
Figure 15G:
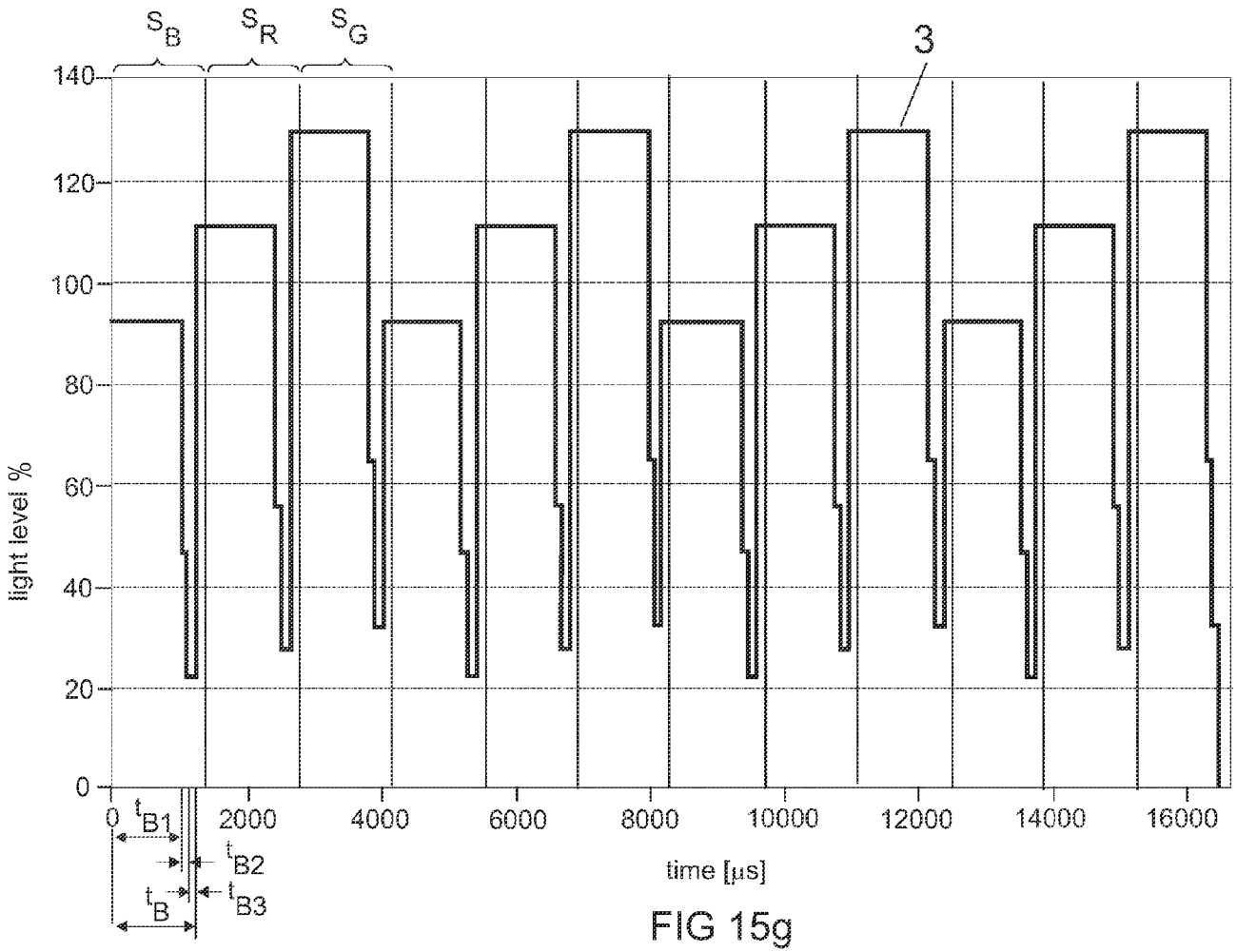
Figure 16:
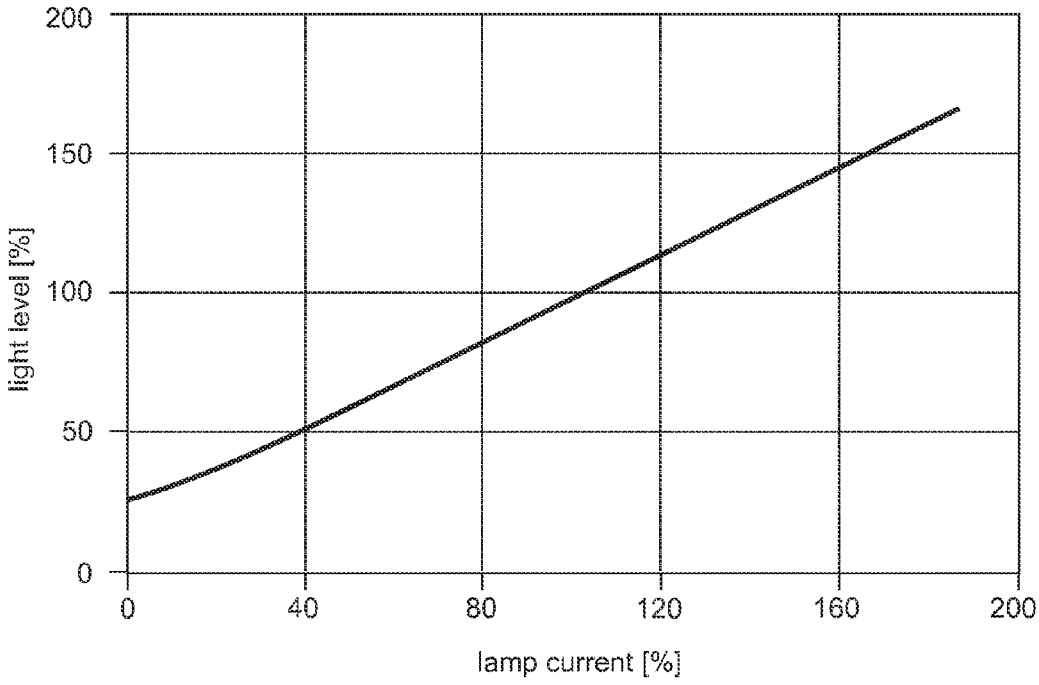
Figure 17:
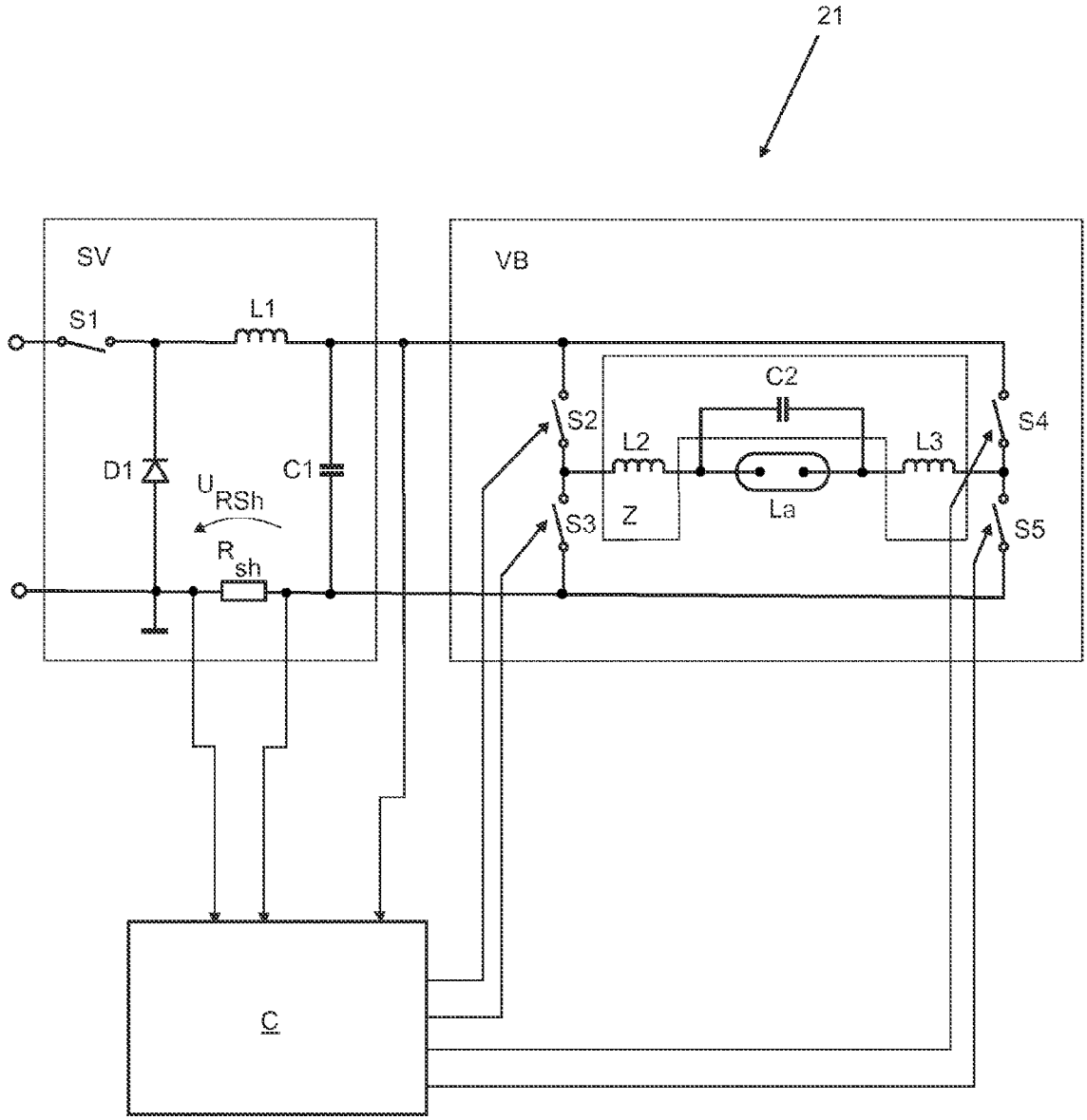

FIG. 6*a* shows a graph in which is illustrated the relationship between the lamp voltage and the commutation frequency in a first form of the third embodiment of the operating method;

FIG. 6*b* shows a graph in which is illustrated the relationship between the lamp voltage and the commutation frequency in a second form of the third embodiment of the operating method;

FIG. 6*c* shows a curve profile of the lamp current for the second form of the third embodiment of the operating method;

FIG. 7 shows a signal flow chart for schematically illustrating a fourth embodiment of an operating method;

FIG. 8 the temporal course of the lamp voltage after switching on a discharge lamp;

FIG. 9 shows the temporal course of the power P relative to the nominal power $P_{nom}$ during an exemplary embodiment of the operating method according to the invention;

FIG. 10 shows the state of the front part of the electrodes in the initial state (FIG. *a*)), after surfusion (FIG. *b*)), and the growth of the electrode tips in the initial phase (FIG. *c*)) and in the state of completed regeneration (FIG. *d*));

FIG. 11 shows the temporal course of the lamp current and the lamp voltage in the case of activation using an asymmetric current-duty cycle during the surfusion phase;

FIG. 12 shows a schematic illustration of an exemplary embodiment of a lighting apparatus for executing the method;

FIG. 13 shows a schematic sectional illustration of a first exemplary embodiment of a display system;

FIG. 14 shows a schematic diagram of a light curve which is used in the first exemplary embodiment of the display system;

FIGS. 15A-C show schematic diagrams of three exemplary light curves for operation of a lighting apparatus in accordance with the operating method of the fifth embodiment;

FIG. 15D shows a tabular illustration of the light curve from FIG. 15C;

FIGS. 15E-G show schematic diagrams of three further exemplary light curves for exemplary explanation of the structure of a light curve;

FIG. 16 shows a schematic diagram of an exemplary intensity or current/illuminance characteristic curve of a light source for operating a lighting apparatus in accordance with the invention;

FIG. 17 shows a schematic circuit diagram of an exemplary circuit arrangement for executing the operating method according to the invention.

DETAILED DESCRIPTION

The following detailed description refers to the accompanying drawings that show, by way of illustration, specific details and embodiments in which the invention may be practiced.

First Embodiment

Figure 1:
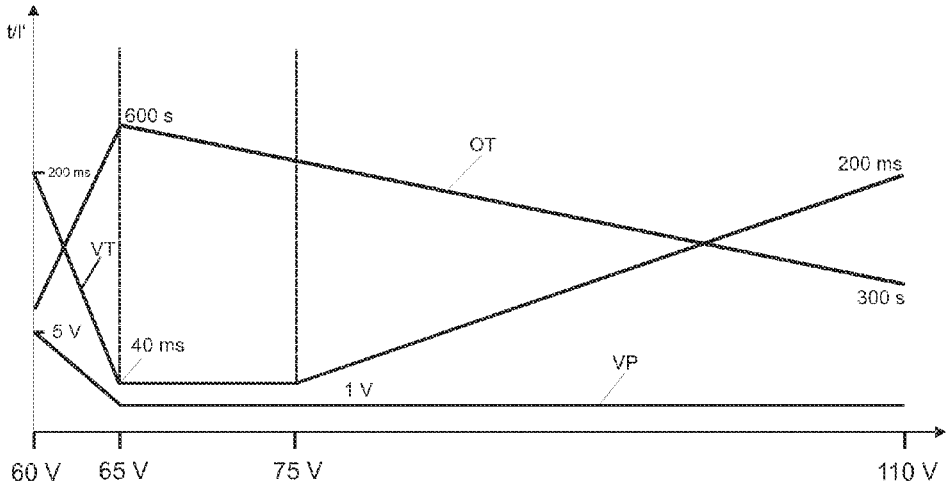
FIG. 1 shows a graph illustrating the relationship between the duration of a DC voltage phase which is applied to the gas discharge lamp, the off-time between two consecutive DC voltage phases, and the maximal voltage change of the lamp voltage as a function of the lamp voltage, for a first and a second embodiment of the operating method.

FIG. 1 shows a graph illustrating the relationship between the duration of a DC voltage phase (curve VT) which is applied to the gas discharge lamp, a separation between two DC voltage phases (curve OT), a voltage change in the DC voltage phase (curve VP), and the lamp voltage for a first embodiment of the operating method according to the invention. The curve VT therefore illustrates the length of the DC voltage phase as a function of the lamp voltage. The curve OT illustrates the separation (also referred to in the following as the off-time) between two DC voltage phases, i.e. the time before a DC voltage phase is re-applied to the gas discharge lamp. Since the electrode more or less fuses when a DC voltage phase is applied, and the electrode separation and hence the lamp voltage increases, this is greater after the DC voltage phase than before the DC voltage phases. The curve VT then shows the change of the lamp voltage during the DC voltage phase as a function of the lamp voltage. If the electrode separation is very small, the change may be considerable, up to 5 V in the present case, since an increase in the electrode separation is greatly desired. After the optimal lamp voltage range from 65 V to 75 V, the maximal change in the lamp voltage should then be only 1 V. The inventive method ensures a defined separation of the electrode tips and a shape of the electrode ends which is as far as possible smooth and has little fissuring, throughout the whole service life of the gas discharge lamp. This is achieved by means of DC voltage phases, which surfuse the electrode ends and promote electrode growth as required.

The following explains what a DC voltage phase is: DC voltage phases consist of the omission of some commutations. These omissions are so positioned that the electrodes are only ever loaded alternately in each case, meaning that one electrode acts first as an anode during a DC voltage phase, then, following a pause for normal lamp operation, the other electrode acts as an anode during a DC voltage phase. The frequency per se is not changed. During a positive DC voltage phase, only a first electrode of the gas discharge lamp is ever heated up, and during a negative DC voltage phase, only a second electrode of the gas discharge lamp is ever heated up. Since a positive DC voltage phase only ever acts on the first electrode and a negative DC voltage phase only ever acts on the second electrode of the gas discharge lamp, various states of the gas discharge lamp electrodes can be changed depending on the procedure. In an alternative method, strictly speaking no commutations are omitted, but each "normal" commutation is "reversed" by a further commutation which follows immediately thereupon. This operating model therefore generates pseudo commutations which simulate an omission of a commutation in principle, but actually represent two commutations which are executed rapidly one after the other. This is sometimes necessary for technical reasons, in order that the circuit arrangement for executing the inventive method can be simpler in design. Depending on the length and the resulting energy input of the DC voltage phases, various physical processes can be intensified in the gas discharge lamp burner. The DC voltage phases are therefore created by omitting commutations or by introducing pseudo commutations. In the second variant, they are therefore not DC voltage phases in the strict sense, since the voltage and hence the current direction meanwhile reverses polarity twice per pseudo commutation, and any number of pseudo commutations can occur per 'DC voltage phase'.

Very long DC voltage phases characterized by high energy input fuse the whole end of the relevant electrode for a short time. During the short period in which the electrode end is molten, the end assumes a spherical or oval shape due to the surface voltage of the electrode material. The electrode tips fuse and are neutralized by the surface voltage of the electrode material. This results in a slight increase of the arc length and therefore the lamp voltage due to the regeneration of the electrode tips.

Short DC voltage phases only cause a surfusion of the electrode tips, such that the shape of the electrode tips can be influenced. This is utilized for the purpose of conserving the electrode tips in the most optimal shape possible over the entire burning life, and for generating a defined centrically positioned tip.

A so-called maintenance pulse can accelerate the tip growth of the electrode tip, and is preferably applied after an extended DC voltage phase in order to allow regrowth, on the oval or round electrode end, of an electrode tip which generates a good arc root point. In this context, a short current pulse which is applied shortly before or after the commutation to the gas discharge lamp in order to heat the electrode is referred to as a maintenance pulse. The length of the maintenance pulse is between 50 μs and 1500 μs long, wherein the current level of the maintenance pulse is greater than during stationary operation. As a result, surfusion of the outer end of the electrode tip is achieved, the thermal inertia thereof having a time constant of approximately 100 μs.

In a first embodiment of the method according to the invention, the lamp is subjected at regular intervals to a DC voltage phase whose length is always dependent on the lamp voltage. The intervals between two DC voltage phases are also dependent on the lamp voltage. The method uses the characteristic curve VT as per FIG. 1 for the purpose of calculating the length of the DC voltage phases that are applied to the gas discharge lamp.

In the case of a very low lamp voltage, which normally occurs in the case of a new gas discharge lamp, and which relates to the left-hand part of the characteristic curve VT, extended DC voltage phases are applied to the gas discharge lamp in order to melt down the grown electrode tips and prevent the electrode separation from becoming too small. The lower the lamp voltage, the longer the DC voltage phases. The DC voltage phases are applied to the lamp below a minimal lamp voltage. The range of the minimal lamp voltage varies between 45 V-85 V depending on the lamp type, in particular between 55 V-75 V. In the context of the gas discharge lamp in the present embodiment, the minimal voltage is 65 V. Extended DC voltage phases are therefore applied to the gas discharge lamp burner below 65 V. In the preferred embodiment, the length of the DC voltage phases is 40 ms at 65 V, wherein the DC voltage phases become longer as the voltage decreases, thereby reaching a length of 200 ms at 60 V. The length of the DC voltage phases can vary between 5 ms and 500 ms depending on the lamp type. The DC voltage phases are applied to the gas discharge lamp at regular intervals. The intervals are dependent on the lamp voltage, but are not shorter than 180 s. In the preferred embodiment, the duration between two DC voltage phases (off-time OT) as shown in FIG. 1 (curve OT) is 200 s at 60 V lamp voltage, wherein said duration increases to 600 s at 65 V lamp voltage, then drops back again to 300 s at 110 V lamp voltage. In another configuration (not shown), the duration increases between two DC voltage phases from 180 s at 60 V to 300 s at 65 V, then drops back again to 180 s at 110 V lamp voltage. In principle, the time span between two DC voltage phases can vary between 180 s and 900 s depending on the lamp type. In summary, it can therefore be stated that, at low voltage, the DC voltage phases are applied more frequently to the gas discharge lamp, and are also applied for longer and are therefore richer in energy. At high lamp voltage, the rate of occurrence of the DC voltage phases likewise increases again, reaching 200 ms again at 110 V. Between the DC voltage phases, a maintenance pulse is always used during normal operation in order to support the centric growth of electrode tips on the electrode end.

At an optimal lamp voltage in the central region of the characteristic curve VT, only very short DC voltage phases are applied to the gas discharge lamp, which only briefly fuse the electrode tips and therefore conserve their shape. The rate of occurrence of the DC voltage phases is minimal in this region. The length of the DC voltage phases is approximately 40 ms in the preferred embodiment. The length of the DC voltage phases can be between 0 ms and 200 ms depending on the lamp type. In many lamp types, the DC voltage phases can also be omitted completely in this region.

As the gas discharge lamp becomes older, so the lamp voltage increases, this being caused by the burning back of the electrodes and the associated longer electric arc. In the case of older lamps, there is a high risk that the electrode end is fissured, and the electrode tips can no longer grow centrically. Long and energy-rich DC voltage phases are therefore applied to the gas discharge lamp burner, lightly surfusing the electrode ends and thereby generating an electrode surface which is as smooth as possible. This can be considered as polishing the shape of the electrode end. The DC voltage phases are also applied to the gas discharge lamp with increasing frequency as the lamp voltage increases, this being indicated by the curve OT. Above an upper voltage threshold, the parameters can be held constant. The duration of the DC voltage phases varies in the preferred embodiment from 40 ms at 75 V to 200 ms at 110 V lamp voltage of the gas discharge lamp burner. In this case, the duration of the DC voltage phases can vary from 2 ms to 500 ms depending on the lamp type. The time span between two DC voltage phases in the present embodiment is 180 s at 60 V lamp voltage, then rises to 600 s at 65 V lamp voltage, and falls to 300 s at 110 V lamp voltage. The time span between two DC voltage phases can vary between 180 s and 900 s depending on the lamp type. In summary, it can be stated that the duration of the DC voltage phases increases when the lamp voltage increases, wherein the DC voltage phases are applied to the gas discharge lamp more frequently in the case of increasing lamp voltage and in the case of very low lamp voltage.

Second Embodiment

Figure 2:
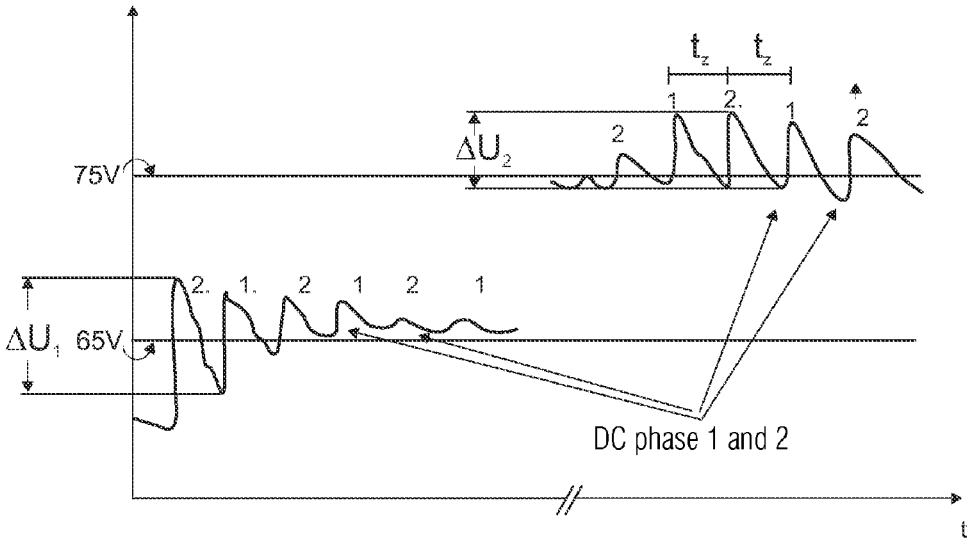
FIG. 2 shows a graph illustrating a second embodiment of the operating method.

In a second embodiment of the method, the length of the DC voltage phases is not controlled via a characteristic curve, instead the length of the DC voltage phases is regulated via the lamp voltage in the DC voltage phase itself. The above described curve VP shows the maximal voltage change of the lamp voltage in the DC voltage phase as a function of the lamp voltage. The voltage change is measured during the DC voltage phase. For this, the circuit arrangement which executes the method features a measuring apparatus, which can measure the lamp voltage before the DC voltage phase, and particularly the change of the lamp voltage during a DC voltage phase. The change of the lamp voltage during the DC voltage phase is evaluated in respect of an interrupt criterion, and the DC voltage phase is terminated when the interrupt criterion is reached. FIG. 2 shows a graph which illustrates the method of the second embodiment. There are two threshold values, the second embodiment being executed if said threshold values are not reached or are exceeded. As long as the lamp voltage lies within the optimal range between the threshold values of 65 V and 75 V, the gas discharge lamp is operated in the normal operating mode without the application of DC voltage phases. However, if the lamp leaves this voltage range, DC voltage phases are applied to the lamp. The length of the DC voltage phases depends on the lamp voltage, and particularly on the change of the lamp voltage, which is present during the DC voltage phases. The DC voltage phases are maintained until the lamp voltage has risen to a previously calculated or predetermined value $\Delta U_1$, $\Delta U_2$. The voltage rise of the lamp voltage in the DC voltage phase is between 0.5 V and 8 V depending on the gas discharge lamp. In a preferred embodiment, the desired voltage rise is between 5 V at 60 V and 1 V at 65 V. If the lamp voltage rise is not achieved within a predetermined maximal time, the DC voltage phase is terminated in order to prevent damage to the electrodes. Following an off-time in accordance with the curve OT, during which no DC voltage phases may be applied, the method is executed anew, i.e. the lamp voltage is measured and a further DC voltage phase is applied if the lamp voltage lies outside of the optimal range of 65-75 V. These steps are repeated periodically as often as required until the lamp voltage lies in the optimal range again.

In the method described below, a DC voltage phase which previously always consisted of a positive phase for the first electrode and a negative phase for the second electrode, is divided into these two phases in order to treat different states of the two lamp electrodes. In a first form of the second embodiment, which is suitable for equalizing an asymmetrical electrode geometry, the length of the DC voltage phase for the previously calculated voltage rise is determined for the first electrode, and is applied to the second electrode in an inverse DC voltage phase following thereupon.

In a second form, which acts symmetrically on both electrodes, the length of the DC voltage phases for each electrode is calculated from the voltage rise during the DC voltage phases. The level of the voltage rise is identical for both DC voltage phases in this context.

In a third form, individual electrode shaping is effected in order to center the light arc in the burner axis. The following method steps are executed in the third form:

In the first step, the length of the electrode tip is calculated according to the relation:

$$l_{electrodetip} \propto \frac{\Delta U_{DCphase}}{T_{DCphase}}.$$

In a second step, the duration or the voltage rise of the DC voltage phase for the desired displacement of the electrode core is calculated proportionally relative to the individual length of the electrode tip:

For an asymmetrical electrode geometry in accordance with the first form, it applies that:

$$\frac{\Delta U_{DCvoltagephase_firstelectrode}}{\Delta U_{DCvoltagephase_secondelectrode}} = \frac{l_{firstelectrode}}{l_{secondelectrode}};$$

$$\Delta U = \Delta U_{DCvoltagephase_firstelectrode} + \Delta U_{DCvoltagephase_secondelectrode}.$$

For a symmetrical electrode geometry in accordance with the second form, it applies that:

$$\frac{T_{DCvoltagephase_firstelectrode}}{T_{DCvoltagephase_secondelectrode}} = \frac{l_{secondelectrode}}{l_{firstelectrode}};$$

$$T = T_{DCvoltagephase_firstelectrode} + T_{DCvoltagephase_secondelectrode}.$$

The third form of the second embodiment of the method offers new advantages, which the previous methods according to the prior art cannot provide. By virtue of the possibility of asymmetrical introduction of energy into the respective electrodes, it becomes possible to center the electrode system core and keep it in its centered position throughout the service life. By virtue of the centered position of the electrode core within the burner vessel, a more stable and effective light yield can be produced by the optical system, which is computed relative to a defined electrode position. The discharge arc remains at the focal point throughout the service life of the lamp. By virtue of the arc root points always being situated centrically on the electrode, an average maximal separation of the discharge arc from the burner vessel wall is produced throughout the service life, effectively reducing any denitrification of the burner vessel. In an advanced optical system, it would also be conceivable for the optical system to optimize and therefore maximize its overall efficiency by means of a control loop in which the electrode shaping mechanism is included.

It is naturally also possible to conceive of a method in which the first embodiment and the second embodiment are used in combination, in order to conserve the electrodes and the electrode tips in an optimal state. An advantageous combination could make provision for using a method of the second embodiment, in which the length of the DC voltage phase is determined by means of the lamp voltage change during this DC voltage phase, in the case of lamp voltages below the lower lamp voltage threshold, and for using a method of the first embodiment, in which the length of the DC voltage phase is calculated or is predetermined by means of a characteristic curve, in the case of lamp voltages above the upper lamp voltage threshold.

Figure 3A:
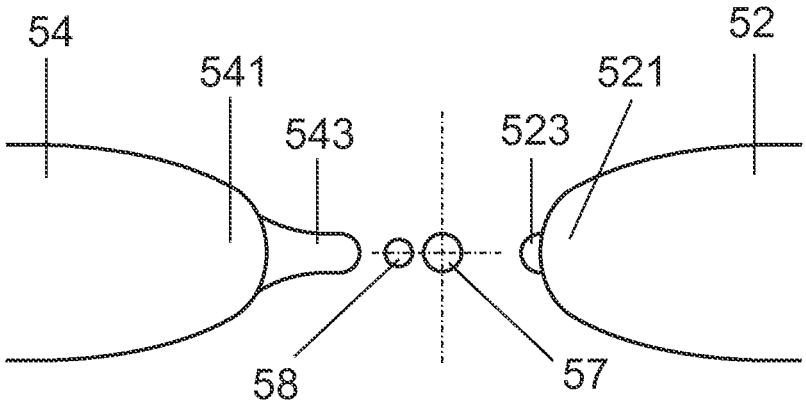
FIG. 3 shows an illustration of an electrode pair before and after optimization by means of the method in the second embodiment.
Figure 3B:
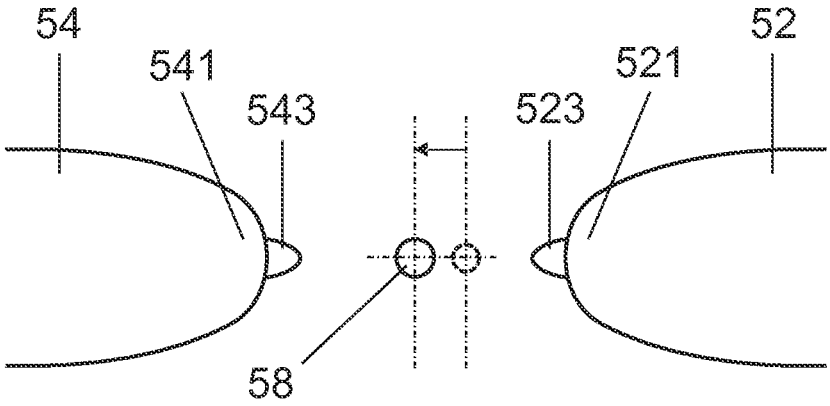

FIG. 3 shows an illustration of an electrode pair before and after the optimization of the method in the second embodiment. FIG. 3*a* shows an electrode pair 52, 54 featuring the electrode ends 521, 541 and the electrode tips 523, 543 before the application of the method in the second embodiment. The central point 57 of the electrodes is not situated in the optimal central point 58 of the burner vessel, since the electrode tip 543 has grown considerably further than the electrode tip 523. Therefore the method is applied in its second embodiment, in the form for equalizing an asymmetrical electrode geometry. After the method has been carried out, the electrodes 52, 54 appear as illustrated in FIG. 3*b:* both electrode tips 523, 543 are again of identical length and the central point 57 between the electrode tips is again located at the central point of the burner 58. The discharge arc again burns optimally in the central point of the burner vessel, and the optical efficiency of the overall system is maximized.

Figure 4:
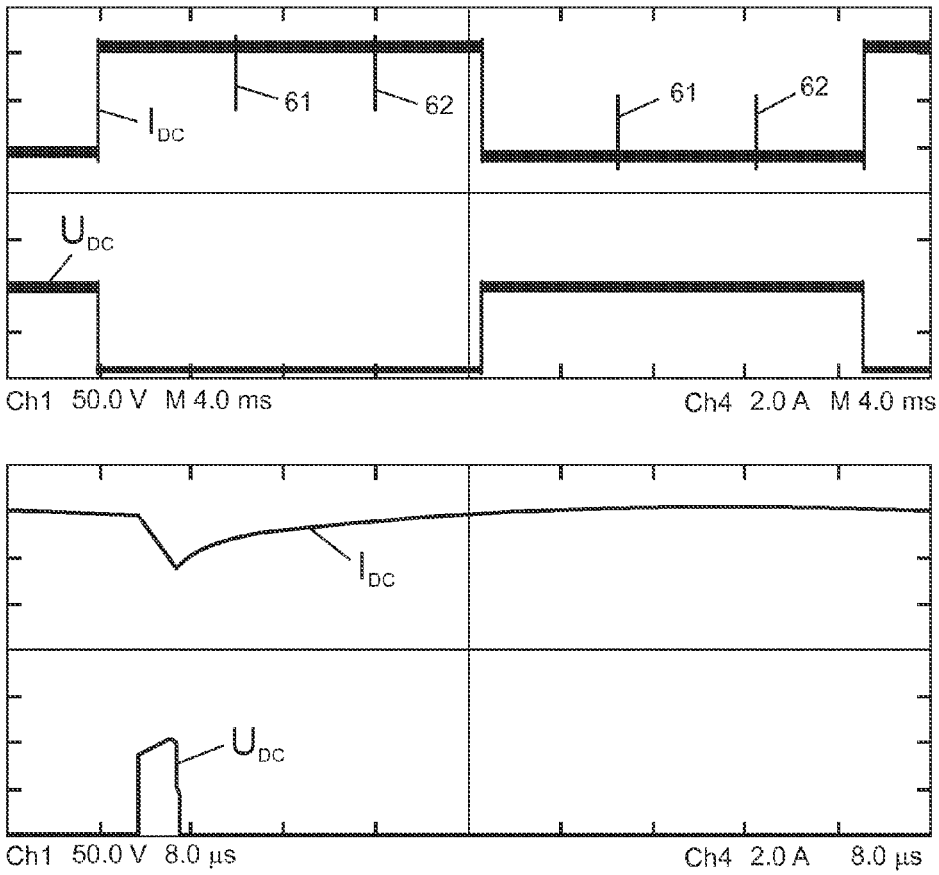
FIG. 4 shows the course of lamp voltage and lamp current during a DC voltage phase, including different temporal resolutions.

FIG. 4 shows the course of the lamp voltage $U_{DC}$ and of the lamp current $I_{DC}$ during a DC voltage phase, using different temporal resolution. In the upper graph, the two curves are shown in a limited temporal resolution of 4 ms/DIV. It is particularly clear from the current that the positive and the negative DC voltage phase consists of 3 normal half-waves. This is easily identifiable from the 2 needle-shaped current pulses 61, 62, which divide the DC voltage phase into 3 regions. These pulses can also be seen in the lamp voltage. The lower graph shows one of the these pulses in a higher temporal resolution of 8 μs. The double commutation can be clearly seen in the lamp voltage $U_{DC}$ in particular here, said voltage $U_{DC}$ jumping with a positive edge to its higher value and approximately 2 μs later jumping back with a negative edge to its lower value, where it stays until the next commutation point. The lamp current $I_{DC}$ wants to vary after the first commutation, but is too slow, and therefore only a small current interruption is recorded during the 2 μs. This is because, as already mentioned in the introduction, the current commutation occurs more slowly than the voltage commutation.

Figure 5:
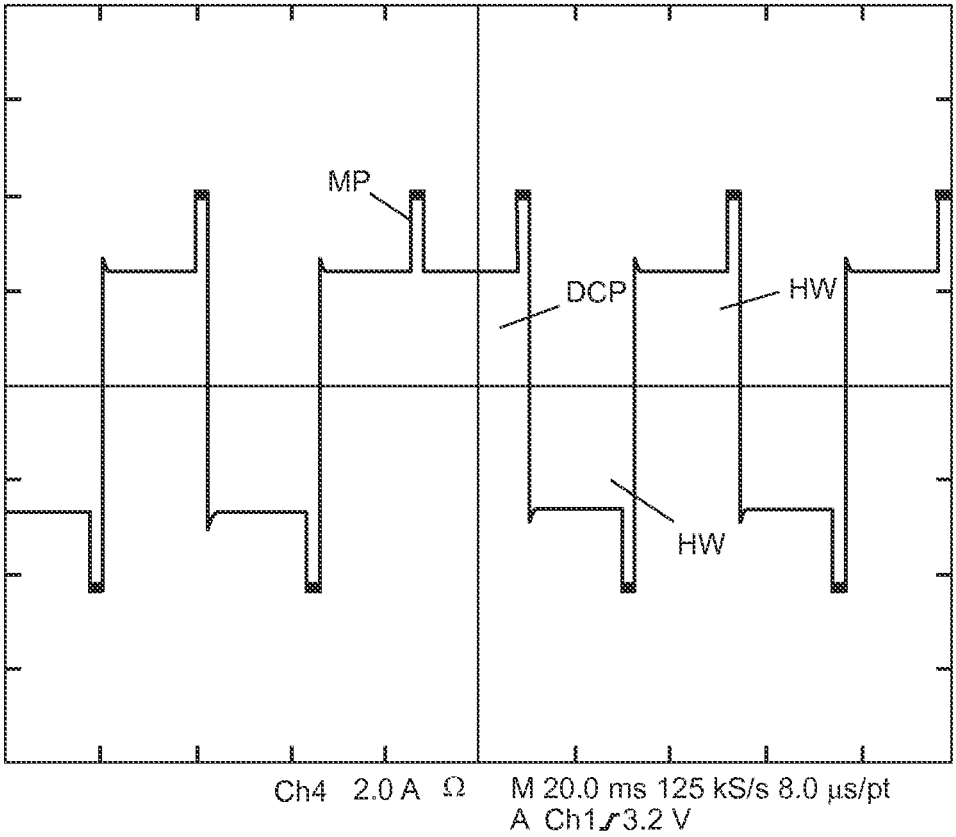
FIG. 5 shows the course of the lamp current during an operating mode which has maintenance pulses.

FIG. 5 shows a course of the lamp current, wherein the gas discharge lamp is operated using the maintenance pulses MP cited above. Here again, it can clearly be seen that the DC voltage phase DCP consists of two half-waves HW, since two maintenance pulses MP occur in the DC voltage phase.

The DC voltage phases are therefore composed of half-waves of the normal operating frequency, and therefore the highest operating frequency is always a whole-number multiple or a fractional rational multiple of the frequency of the DC voltage phases.

Third Embodiment

In a third embodiment of the method, a continuous adaptation of the operating frequency takes place as a function of the lamp voltage. The method can be operated in various forms in this case. In a first form of the third embodiment, as illustrated in FIG. 6*a*, the operating frequency is changed in discrete steps depending on the lamp voltage. In this case, the frequency becomes higher as the lamp voltage increases. Since a commutation can only take place at specific times due to various outline conditions in the overall system, the operating frequency can only assume a limited number of frequency values. If the gas discharge lamp is operated in a video projector including a color wheel, for example, the operating frequency of the gas discharge lamp can only be commutated if the color wheel is in a position at which a change from one color segment to the next is taking place at the time. Due to the constant rotational speed of the color wheel, which in turn depends on the image refresh frequency of the video image, the frequency of the commutations is essentially predetermined by a circulation of the color wheel.

In order to ensure optimal operation of the gas discharge lamp, however, a fixed operating frequency should always be maintained for a specific lamp voltage. In the present example, assuming a lamp voltage between 0 V and 50 V, a lamp current having an operating frequency of e.g. 100 Hz is applied to the gas discharge lamp. However, since the operating frequency can only assume a small number of discrete frequency values as a result of the aforementioned outline conditions, the adaptation of the operating frequency to the lamp voltage is rather approximate. The highest operating frequency is the frequency at which a commutation is carried out at every possible commutation time point. This frequency is the highest frequency that can be represented in the system. The possible commutation time points, which are predetermined by the above mentioned outline conditions relating to e.g. a color wheel, are also referred to as commutation points as mentioned previously.

In a second form of the third embodiment of the method, the operating frequency of the gas discharge lamp is continuously adapted with reference to a characteristic curve. The characteristic curve of a preferred embodiment is illustrated in FIG. 6*b*. Up to a certain lamp voltage of 50 V in this case, the operating frequency always remains the same at approximately 100 Hz. Above a lamp voltage of 50 V, the operating frequency rises continuously up to a lamp voltage of 150 V. As a result of the observations made above, it is not possible to deliver every operating frequency directly. A method is therefore applied in which the inverter operates the gas discharge lamp using a sequence of discrete frequencies, all of which represent a whole-number or fractional rational fraction of the highest operating frequency. In order to represent these lower frequencies, commutation is not actually effected at each commutation point, two or more partial half-waves instead being combined in each case to form a resulting half-wave HW, such that the period duration of the resulting half-wave is a whole-number or fractional rational factor of the original partial half-wave, as illustrated in FIG. 5. A commutation pattern is therefore generated, which can have a very irregular appearance during the course of time. The commutation pattern consists of a serial arrangement of half-waves of varying discrete frequencies. A control unit which executes the method then mixes these discrete frequencies in their rate of occurrence such that the time-relative average value of the frequencies corresponds to the desired operating frequency that is to be set for the gas discharge lamp. FIG. 6*c* shows an exemplary curve profile with commutation points 31, 32, 33, 34, 35 at which a commutation can occur if required. If a commutation occurs at each of these points, the highest operating frequency is produced and a half-wave is exactly one partial half-wave long in each case. This embodiment also offers the possibility of actually omitting commutations again, or of executing two rapid commutations consecutively instead of omitting the commutation. By virtue of the commutations being executed only when needed, and therefore at least two different coarsely stepped frequencies being generated, wherein these can then be adjusted by means of the their rate of occurrence to provide a resulting average frequency which is very finely adjustable, it is possible to satisfy all of the outline conditions while nonetheless operating the gas discharge lamp using the optimal frequency on average relative to time. This has the advantage that the predetermined commutation points that are often required by video projection systems, for which the manufacturer of the video projection system specifies a fixed frequency in order that the synchronization with the video signal and with a color change unit located in the optical system can be achieved, can always be observed and that the method can therefore also be carried out in the case of applications for which a fixed frequency is predetermined by the commutation points. It is clear from this figure that the method is also suitable if the possible commutation points themselves are not always equally separated. In many advanced video projection systems, the various color sectors of the color wheel are also of varying width, and therefore the temporal distances between the possible commutation points are different. This does not represent a problem in the context of the present method, since the supervisory control unit can take this into consideration and, using the multiplicity of frequencies exhibited by the different half-waves, can adapt the time-relative average value of the resulting frequency exactly to the predetermined operating frequency of the gas discharge lamp by means of the previously mentioned distribution of rate of occurrence relative to time.

Fourth Embodiment

FIG. 7 shows a signal flow chart for schematically illustrating a fourth embodiment of the method. Said method begins in the step 100 with the starting (i.e. ignition) of the lamp. In the step 120 following thereupon, a check establishes whether at least one parameter lies in a value range which is associated with the first and/or the second electrode being fissured. This parameter is preferably the lamp voltage or the duration of operation since the first activation or since the last execution of the method, or the separation of the electrodes. If the response to this question is negative, operation of the gas discharge lamp continues in the normal lamp operating mode in the step 150. If the response to this question is positive, operation of the lamp likewise initially continues in the normal lamp operating mode in the step 125. During this time, however, a periodic check establishes whether a start criterion for the surfusion is satisfied. The start criterion can be the occurrence of a specific lamp voltage $U_{OVref}$, for example. During this time, no surfusion step is executed as part of the normal lamp operation. As soon as the start criterion is satisfied, the surfusion of the electrodes is initiated in the step 135. Preferably at equidistant time intervals, a check in the step 140 establishes whether an interrupt criterion for the end of the surfusion phase is satisfied. This can preferably be if the lamp voltage rises above a reference value $U_{OVref}$. If the response is negative, provision is made for continuing in step 135 and then executes the query again in the step 140. This repetition of the steps 135, 140 continues until the response to the question is positive in the step 140, whereupon the method proceeds to step 150 where, during the normal lamp operation in the stationary state, new electrode tips are grown on the front part of the electrodes. During this time, provision is made for branching to step 120 at regular intervals in order to ensure a continuous control loop which conserves the electrodes of the gas discharge lamp as far as possible in an optimal state at all times.

FIG. 8 shows a schematic illustration of the temporal course of the lamp voltage $U_O$ of a discharge lamp after it is switched on. It can be seen that the lamp is operated at a power P during the first 45 s, said power P being lower than the nominal power $P_{nom}$. This phase is referred to as the startup phase, during which the current that is supplied to the lamp is limited in order to prevent the gas discharge lamp or the electronic operating device from being overloaded. In the region after 45 s, although the lamp voltage $U_B$ has not yet risen to its continuous operation value, the lamp is already operating at the nominal power $P_{nom}$ here, i.e. an active limitation on current no longer applies here. This phase is referred to as the power adjustment phase, during which the lamp is essentially operated at its nominal power. The normal lamp operation therefore consists of a startup phase, which begins with the starting of the lamp, and a power adjustment phase, which follows the startup phase and after a certain time becomes the stationary state, during which the gas discharge lamp is essentially operated using its nominal parameters. The startup phase between switching on and 45 s is particularly suitable for carrying out the method, since the burner temperature is still low then and the user is not yet operating the lamp for its intended purpose.

FIG. 9 shows a schematic illustration of the temporal course of the power P relative to the nominal power $P_{nom}$ as a percentage, and of the lamp voltage $U_B$, during the execution of a preferred exemplary embodiment of the method. At first, i.e. during normal operation and in this case until the time point $t_1$, the discharge lamp is operated at the nominal power $P_{nom}$. The power P is then lowered to 30% of the nominal power. This results in cooling of the discharge lamp, thereby producing the advantages mentioned above in connection with FIG. 2. Following thereupon, i.e. at the time point $t_2$, the discharge lamp is operated at a lamp current I, which is between 150 and 200% of the nominal lamp current $I_{nom}$, in order to surfuse the electrodes. With effect from the time point $t_3$, the lamp is operated at a power which is approximately 75% of the nominal power $P_{nom}$. Following thereupon, i.e. with effect from the time point $t_4$, the power is increased in 5% steps, each of which lasts approximately 20 minutes, until it reaches the nominal power $P_{nom}$ or even higher, thereby resulting in the growth of new electrode tips. It can be seen from the course of the lamp voltage $U_O$ that, starting from a constant value which applied during operation of the discharge lamp at the power $P_{nom}$, said lamp voltage $U_O$ falls during operation at lower power and then gradually rises again.

Figures 10A, 10B, 10C, 10D:
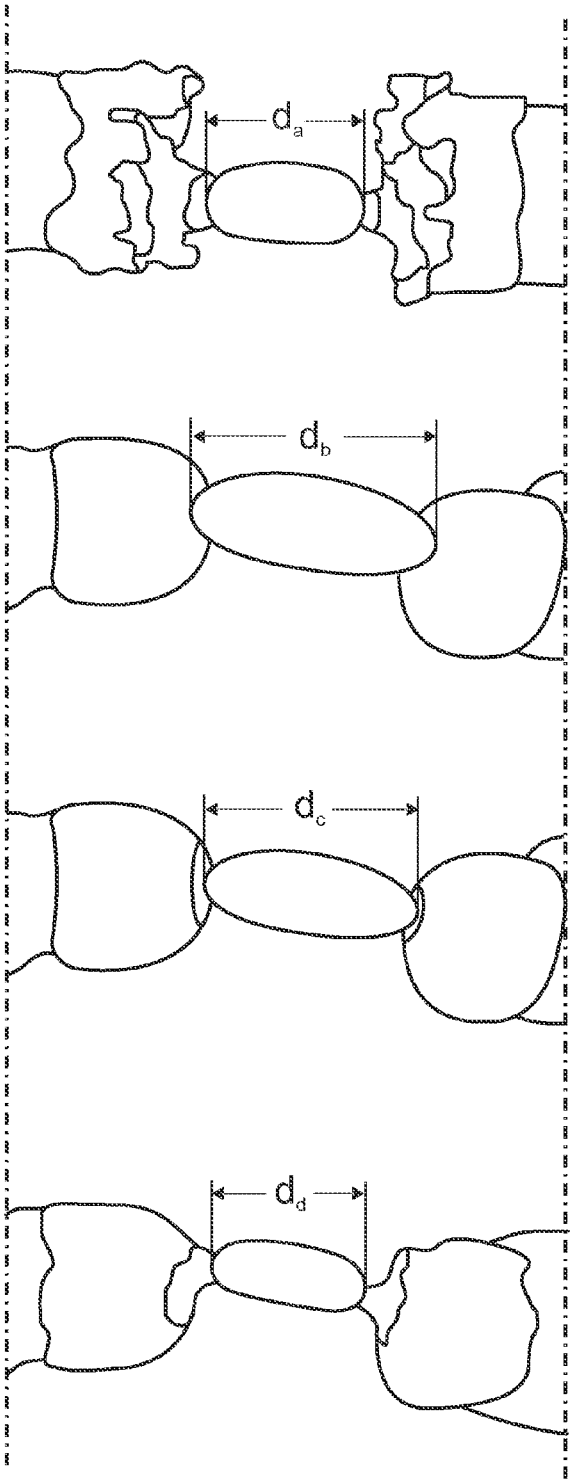

FIGS. 10*a*) to *d*) show the state of the front parts of the electrodes at different stages of the execution of the method. FIG. 4*a*) shows the state before the execution of the method. The front parts of the electrodes are clearly fissured, the electrode tips are non-centrically arranged, and the separation of the electrodes is $d_a$. FIG. 10*b*) depicts the state shortly after the surfusion of the front parts of the electrodes. The hemispherical shape of the front parts of the electrodes, which is produced during surfusion as a result of the surface voltage, is clearly visible. A smooth electrode surface can now be seen instead of the fissures. The separation has increased to $d_b$. In this state, small irregularities on the electrodes are sufficient to allow jumping of the arc root points, which would result in a flickering of the discharge lamp. In the step illustrated in FIG. *c*), provision is therefore made for growing electrode tips on the front parts of the electrodes. As a result of the growth of the electrodes, the separation becomes smaller. It is now $d_c$, where: $d_a<d_c<d_b$. Finally, FIG. 4*d*) shows the state after the regeneration is complete, i.e. following the step for the growth of the electrode tips. The surface of the front side of the electrodes remains free of fissures, while electrode tips have nonetheless grown, whereby the separation $d_d$ has decreased in comparison with the illustration in FIG. *c*). It applies that $d_d \leq d_a<d_c<d_b$. The greater light yield is also noticeable in comparison with FIG. 4*a*.

While projectors are a preferred application of discharge lamps and hence of the method, the method nonetheless relates to all types of discharge lamps, including e.g. Xenon car lights in particular. It is again pointed out that the electronic operating devices previously used for operating a discharge lamp need not be exposed to a higher load for the purpose of executing the method, since the current-time integral is critical, and therefore a lower current is simply applied for longer if applicable.

FIG. 11 shows the temporal course of the lamp current, above and of the lamp voltage $U_O$ below, in the context of activation using an asymmetrical current duty cycle during the surfusion phase. It is clear that individual commutations are executed twice in immediate succession. Two commutations executed in immediate succession are referred to as so-called "dummy commutations". An intended asymmetry or DC component is therefore generated in the lamp current. It is likewise evident that the lamp voltage $U_O$ increases as intended. Alternatively, it is also possible to omit individual commutations.

Fifth Embodiment

The fifth embodiment relates to an operating method which can be executed in conjunction with an operating device for the additional purpose of improving the image quality in a lighting apparatus in addition to the electrode shaping. The lighting apparatus 10 according to the exemplary embodiment in FIG. 12 includes a light source 1, this being a gas discharge lamp here, which emits light having a spectrum locus in the white range of the CIE standard color table. In the case of the gas discharge lamp 1, this is a point light source which has a very small arc separation and a high energy density of 100 W/mm$^3$ to 500 W/mm$^3$.

The lighting apparatus 10 according to FIG. 12 additionally includes an operating device 2, such as e.g. a function generator, which can provide electrical signals having a power of 100 W to 500 W and executes the method according to the invention. The operating device 2 activates the light source 1 in accordance with the inventive method using an electrical current intensity signal which follows a light curve 3. Light curves 3 are explained in greater detail below in connection with FIGS. 13 and 15A to 15C.

The light curve 3 in the exemplary embodiment according to FIG. 15A includes in each case a periodic sequence of three segments $S_R$, $S_G$, $S_B$. The first segment $S_B$ is assigned to the color blue, the second segment $S_R$ to the color red and the third segment $S_G$ to the color green. As an alternative to the light curve 3 according to FIG. 14, this light curve 3 can be stored e.g. in the operating device 2 of the lighting apparatus 10, 11, which is used in the display systems according to FIG. 13. In this case, the different segments of the light curve are assigned to different partial half-waves, of which the alternating current to be applied to the gas discharge lamp consists, such that the lamp current follows the stored light curve. Since the light output of the gas discharge lamp correlates to the lamp current, the light output of the gas discharge lamp follows the stored light curve.

The first segment $S_B$ of the light curve in FIG. 15A is assigned to the color blue and has a duration $t_B$ of approximately 1300 μs. During this time interval $t_B$, the light level of the lighting apparatus 10, 11 is approximately 108%.

Adjoining the first segment $S_B$ is a second segment $S_R$, which is assigned to the color red and has a duration of $t_R$. During a first time interval $t_{R1}$ of the time interval $t_R$, the light level of the lighting apparatus 10, 11 is briefly approximately 150%, while the light level in a second time interval $t_{R2}$, which immediately follows the first time interval $t_{R1}$ and with this forms the time interval $t_R$, is approximately 105%. The time interval $t_{R1}$ is clearly shorter than the time interval $t_{R2}$ here. The time interval $t_{R1}$ is approximately 100 μs in this case, while the time interval $t_{R2}$ is approximately 1200 μs in this case.

Adjoining the second segment $S_R$ is a third segment $S_G$, which is assigned to the color green and has a duration $t_G$ of likewise approximately 1300 μs. Like the time interval $t_R$, the time interval $t_G$ is also divided into two time intervals $t_{G1}$ and $t_{G2}$, wherein the first time interval $t_{G1}$ is clearly longer than the second time interval $t_{G2}$. The first time interval $t_{G1}$ is approximately 1200 μs in this case, while the second time interval $t_{G2}$ of the green segment has a duration of approximately 100 μs. During the first time interval $t_{G1}$, the light curve 3 has a constant value of approximately 85%, briefly dropping to a value of approximately 45% for the time interval $t_{G2}$.

After expiry of these three segments $S_R$, $S_G$, $S_B$, there follows an essentially periodic repetition of these three segments $S_R$. $S_G$, $S_B$, wherein the arrangement of the short time intervals $t_{R1}$, $t_{G2}$ within the segments, in which the light level is clearly higher or lower relative to the remainder of the segment $S_R$. $S_G$, differs from the periodicity. Those short time intervals of the light curve 3 in which the illuminance is significantly lower are used to increase the color depth as described above in the general description. Those short segments within which the illuminance is significantly higher are maintenance pulses, these being used as described above for stabilizing the electrodes of the gas discharge lamps.

FIG. 15B shows two light curves 3. The diagrams represent the illuminance and the color as a function of the time. They also contain in each case a complete period of the light curve profile, this normally having a duration of between 16 and 20 ms.

The light curve of the exemplary embodiment according to FIG. 15C is configured in relation to a filter wheel 6 which has six different filters including the colors yellow, green, magenta, red, cyan and blue. Accordingly, the light curve 3 is composed of a periodic sequence of six different segments $S_Y$, $S_G$, $S_M$, $S_R$, $S_C$, $S_B$, these being assigned to the respective colors. In the following, the segments $S_Y$, $S_G$, $S_M$, $S_R$, $S_C$, $S_B$ are referred to by the color to which they are assigned. In this context, each segment $S_Y$, $S_G$, $S_M$, $S_R$, $S_C$, $S_B$ of the light curve 3 has a constant value for the light level during most of the duration of the respective segment.

The individual segments $S_Y$, $S_G$, $S_M$, $S_S$, $S_C$, $S_B$ are again assigned time intervals $t_Y$, $t_G$, $t_M$, $t_R$, $t_C$, $t_B$, which are each divided into two or three time intervals $t_{Y1}$, $t_{Y2}$, $t_{G1}$, $t_{G2}$, $t_{M1}$, $t_{M2}$, $t_{M3}$, $t_{R1}$, $t_{R2}$, $t_{C1}$, $t_{C2}$, $t_{C3}$, $t_{B1}$, $t_{B2}$ one of said time intervals being clearly longer than the other in each case. These time intervals are referred as "long time intervals" in the following. The values of the light levels in the long time intervals of the individual segments can be seen in the table in FIG. 15D in the row "segment light level". The yellow and the green segment $S_Y$, $S_G$ have a constant light level of 80% during the long time interval. The magenta-colored and the red segment $S_M$, $S_R$ have a light level of 120% during the long time interval, while the cyan-colored segment $S_C$ has a light level of 80% during the long time interval and the blue segment $S_B$ a light level of 120% during the long time interval. At the end of each segment, there is a short period during which the light level is significantly lower than during the long time interval. These values can be seen in the table in FIG. 15D in the row "negative pulse light level". The light level falls to a value of 40% in the case of the yellow and the green segment $S_Y$, $S_G$, to a value of 60% in the case of the magenta-colored and the red segment $S_M$, $S_R$, to a value of 40% in the case of the cyan-colored segment $S_C$, and to a value of 60% in the case of the blue segment $S_B$. Furthermore, a communication takes place at the end of the magenta-colored segment $S_M$ and at the end of the cyan-colored segment $S_C$, this being symbolized by means of arrows and being associated in each case with a light level that is raised relative to the long time interval.

The segment sizes of the different colors are not identical, this being evident from the table in FIG. 15D in the row "segment size", but have a value of 60° in the case of the yellow and the green segment $S_Y$, $S_G$, a value of 40° in the case of the magenta-colored segment $S_M$, a value of 70° in the case of the red segment $S_R$, a value of 62° in the case of the cyan-colored segment $S_C$, and a value of 68° in the case of the blue segment $S_B$. These values correspond to the light curve 3.

In connection with a light curve 3 whose segments $S_R$, $S_G$, $S_B$ are assigned to the colors red, green and blue, as shown by way of example in FIGS. 14 and 15A, use is normally made of a filter wheel 6 having two red, two blue and two green filters. In this type of configuration, the filters are preferably arranged in the sequence, red, green, blue, red, green, blue. In this type of configuration, the sizes of the individual color filter segments can be identical (60° for all six filters) or different, according to the light curve 3 that is used. Alternatively, the filter wheel can also consist of only one red, one blue and one green filter in each case.

The functions of the individual time intervals within the segments $S_R$, $S_G$, $S_B$ are explained by way of example in greater detail below with reference to FIGS. 15E, 15F and 15G.

In the same way as the light curve 3 according to FIG. 15A, the light curve 3 according to FIG. 15E includes a periodic sequence of a segment $S_B$, which is assigned to the color blue, a segment $S_R$, which is assigned to the color red, and a segment $S_G$, which is assigned to the color green. Each segment $S_R$, $S_G$, $S_B$ has a duration of approximately 1500 μs. The time interval $t_B$, the time interval $t_R$ and the time interval $t_G$, which are assigned to the respective segment $S_R$, $S_G$, $S_B$, therefore have the same length. Within a segment $S_R$, $S_G$, $S_B$, the light curve 3 has a constant value in each case. The light curve 3 has a value of approximately 95% during the time interval $t_B$, a value of approximately 100% during the time interval $t_R$, and a value of approximately 110% during the time interval $t_G$. By means of the different levels of the light curve 3, the light level of the lighting apparatus so adapted that a display system including this lighting apparatus has a desired color temperature.

By way of example, the light curve 3 according to FIG. 15F shows short time intervals $t_{B2}$, $t_{B3}$, $t_{R2}$, $t_{G1}$, $t_{G2}$, $t_{G3}$ at the end of each segment $S_R$, $S_G$, $S_B$, said short time intervals being similar to those described above in connection with FIG. 15A. The light curve 3 is again composed of a periodic sequence of a segment $S_B$, which is assigned to the color blue, a segment $S_R$, which is assigned to the color red, and a segment $S_G$, which is assigned to the color green. The time interval $t_B$, $t_R$, $t_G$ of each segment is subdivided here into three time intervals including one long time interval $t_{1B}$, $t_{1R}$, $t_{1G}$ at the beginning of each segment $S_R$, $S_G$, $S_B$, and two short time intervals $t_{B2}$, $t_{B3}$, $t_{R2}$, $t_{G1}$, $t_{G2}$, $t_{G3}$ respectively at the end of each segment $S_R$, $S_G$, $S_B$. During the short time intervals $t_{B2}$, $t_{B3}$, $t_{R2}$, $t_{G1}$, $t_{G2}$, $t_{G3}$, the light level of the light curve 3 (and hence the alternating current through the gas discharge lamp) is lowered in a stepped manner. The segment $S_B$, which is assigned to the color blue, is described here by way of example. During the time interval $t_{B1}$, the light curve 3 has a value of approximately 110%. During the time interval $t_{B2}$, which immediately follows the time interval $t_{B1}$, the light curve 3 has a value of approximately 55%, while the value of the light curve 3 during the time interval $t_{B3}$, which immediately follows the time interval $t_{B2}$, is reduced to approximately 30%. The time interval $t_{B1}$ has a duration of approximately 1300 μs, while the time intervals $t_{B2}$ and $t_{B3}$ have in each case a duration of approximately 10 μs. The remaining segments $S_R$, $S_G$ of the light curve are structured in an identical manner to the segment $S_B$, which is assigned to the color blue. The lowering of the light curve 3 during the short time intervals $t_{B2}$, $t_{B3}$, $t_{R2}$, $t_{G1}$, $t_{G2}$, $t_{G3}$ serves to improve the color depth of the display system in which the lighting apparatus is used.

The light curve 3 according to FIG. 15G shows the two light curve profiles which were explained above with reference to FIGS. 15E and 15F, combined in a light curve 3 of the type that could also be applied in a lighting apparatus. The description of the short segments $t_{B2}$, $t_{B3}$, $t_{R2}$, $t_{G1}$, $t_{G2}$, $t_{G3}$ at the end of each segment $S_R$, $S_G$, $S_B$ in the FIG. 15F is also valid here for the short time intervals $t_{B2}$, $t_{B3}$, $t_{R2}$, $t_{G1}$, $t_{G2}$, $t_{G3}$ in FIG. 15G, while the levels of the light curve 3 during the long time intervals $t_{B1}$, $t_{R2}$, $t_{G3}$ of each segment $S_R$, $S_G$, $S_B$ correspond to the values as per the light curve 3 in FIG. 15E.

The characteristic curve for current intensity/illuminance in the exemplary embodiment according to FIG. 16 is approximately linear. It specifies a current intensity as a percentage on the y-axis and a light level as a percentage on the y-axis.

By means of the characteristic curve for current intensity/illuminance, which can also be stored in the operating device 2 of the lighting apparatus 10, 11, the brightness of the light source 1, 1R, 1G, 1B of the lighting apparatus 10, 11 can be maintained at the illuminance that is predetermined by the light curve 3 in the event of a change of lamp operating parameters, e.g. the current intensity. The correlation via the characteristic curve allows the parameter in the light curve to be directly converted into an alternating current for the gas discharge lamp. In this case, the various plateaus of the light curve are converted into respective partial half-waves, the commutation points being selected by the operating device 2 with reference to synchronization parameters of a video electronics module in the lighting apparatus 10.

The circuit that is illustrated in FIG. 17 represents an example of a circuit arrangement 21 for executing the method according to the invention, wherein said circuit arrangement 21 forms part of the operating device 2. This circuit arrangement 21 is broken down into the following blocks: voltage supply SV, full bridge VB, ignition Z, and control unit C. The blocks SV, VB, C and Z can be constructed in an identical manner to corresponding blocks in conventional circuit arrangements. The voltage supply governs the power of the gas discharge lamp, the lamp voltage being adjusted thus. The lamp power and the corresponding lamp voltage are applied to the full bridge, which generates a square-wave lamp power therefrom, this being applied to the gas discharge lamp. The G1 is started by means of a resonance ignition using the two lamp chokes L2 and L3 and the capacitor C2, which therefore also form the ignition unit Z. The embodiment in FIG. 17 is merely exemplary. The control unit C, which activates the full bridge and the voltage supply, can be constructed as an analog control unit, though the control unit C is preferably a digital regulator which preferably features a microcontroller.

The circuit diagram is merely schematic and not all control and sensor lines are shown.

The invention is not limited by the description referring to the exemplary embodiments. Rather, the invention includes every novel feature and every combination of features, including in particular every combination of features in the claims, even if this feature or this combination is not itself explicitly specified in the claims or in the exemplary embodiments.

The invention claimed is:

1. A method for operating a gas discharge lamp featuring a gas discharge lamp burner and a first and a second electrode, wherein the electrodes have a nominal electrode separation in the gas discharge lamp burner before their first activation and said nominal separation is correlated to the lamp voltage, the method comprising:

checking whether the off-time, corresponding to the time duration between two DC voltage phases, has expired; and if the off-time has expired, omitting commutations or applying pseudo-commutations for a predefined time duration which depends on the lamp voltage in such a way that a time duration of the omission of at least one of commutations and application of pseudo-commutations is predefined for each lamp voltage.

2. The method as claimed in claim 1, wherein the predetermined time period is between 2 ms and 500 ms long depending on the lamp voltage.

3. The method as claimed in claim 1, wherein a lamp current only flows in one direction during the predefined time period.

4. The method as claimed in claim 3, wherein the lamp current only flows in one direction during the predefined time period and flows in the other direction during a predefined time period following thereupon.

5. The method as claimed in claim 1, wherein the lamp current flows proportionally in both directions during the predefined time period.

6. The method as claimed in claim 5, wherein the temporal portions of the current flow is distributed equally.

7. The method as claimed in claim 5, wherein the distribution is in one current flow direction.

8. The method as claimed in claim 1, wherein the off-time is dependent on the lamp voltage.

9. The method as claimed in claim 1, wherein the off-time is between 180 s and 900 s depending on the lamp voltage.

10. The method as claimed in claim 9, wherein the off-time is between 180 s and 600 s depending on the lamp voltage.

11. The method as claimed in claim 1, wherein the predefined time period is determined by a change of the lamp voltage during the DC voltage phases.

12. The method as claimed in claim 11, wherein a maximal value of a change of the lamp voltage during the DC voltage phases is dependent on the lamp voltage before the application of the DC voltage phases.

13. The method as claimed in claim 1, wherein the gas discharge lamp is operated using an alternating current, and at least one pulse of higher current intensity is modulated onto the half-waves of the alternating current, said pulse being between 50 μs and 1500 μs long.

14. The method as claimed in claim 1, wherein a half-wave of the applied alternating current consists of a plurality of partial half-waves, wherein some or all of the commutations between two half-waves are reversed again by means of a further commutation occurring shortly thereafter.

15. The method as claimed in claim 14, wherein the various partial half-waves of a half-wave apply different current intensities to the gas discharge lamp.

16. The method as claimed in claim 1, wherein it is executed during the startup of the gas discharge lamp.

17. The method as claimed in claim 16, wherein the off-time is shorter than 180 s.

18. An electronic operating device, comprising:

an ignition device;

an inverter; and a control circuit;

wherein it executes a method for operating a gas discharge lamp featuring a gas discharge lamp burner and a first and a second electrode, wherein the electrodes have a nominal electrode separation in the gas discharge lamp burner before their first activation and said nominal separation is correlated to the lamp voltage, the method comprising:

checking whether the off-time, corresponding to the time duration between two DC voltage phases, has expired; and if the off-time has expired, omitting commutations or applying pseudo-commutations for a predefined time duration which depends on the lamp voltage in such a way that a time duration of the omission of at least one of commutations and application of pseudo-commutations is predefined for each lamp voltage.

19. A projector; comprising:

an electronic operating device, comprising:

an ignition device;

an inverter; and a control circuit;

wherein it executes a method for operating a gas discharge lamp featuring a gas discharge lamp burner and a first and a second electrode, wherein the electrodes have a nominal electrode separation in the gas discharge lamp burner before their first activation and said nominal separation is correlated to the lamp voltage, the method comprising:

checking whether the off-time, corresponding to the time duration between two DC voltage phases, has expired; and if the off-time has expired, omitting commutations or applying pseudo-commutations for a predefined time duration which depends on the lamp voltage in such a way that a time duration of the omission of at least one of commutations and application of pseudo-commutations is predefined for each lamp voltage, wherein the projector is designed to project an image, during the execution of the method, in such a way that the execution of the method is not apparent from the image.

20. The projector as claimed in claim 19, wherein the projector executes the method shortly after the projector is started.

* * * * *